US011419432B2

(12) United States Patent
Lacey

(10) Patent No.: US 11,419,432 B2
(45) **Date of Patent: *Aug. 23, 2022**

(54) CONFIGURABLE FOAM COMFORT SYSTEM

(71) Applicant: LIFE MATTRESS INC., Bend, OR (US)

(72) Inventor: Adam C. Lacey, Bend, OR (US)

(73) Assignee: Life Mattress Inc., Bend, OR (US)

( * ) Notice: Subject to any disclaimer, the term of this patent is extended or adjusted under 35 U.S.C. 154(b) by 130 days.

This patent is subject to a terminal disclaimer.

(21) Appl. No.: 16/794,656

(22) Filed: Feb. 19, 2020

(65) Prior Publication Data

US 2020/0178701 A1 Jun. 11, 2020

Related U.S. Application Data

(63) Continuation-in-part of application No. 15/611,561, filed on Jun. 1, 2017, now Pat. No. 10,568,437.

(60) Provisional application No. 62/345,503, filed on Jun. 3, 2016.

(51) Int. Cl.
*A47C 27/14* (2006.01)
*A47C 27/15* (2006.01)

(52) U.S. Cl.
CPC ..... *A47C 27/148* (2013.01); *A47C 27/144* (2013.01); *A47C 27/15* (2013.01)

(58) Field of Classification Search
CPC ..... A47C 27/148; A47C 27/144; A47C 27/15; A47C 27/14; A47C 27/142; A47C 27/146; A47C 7/18
See application file for complete search history.

(56) References Cited

U.S. PATENT DOCUMENTS 2,768,924 A * 10/1956 John ..... A47C 27/20 428/72
2,788,061 A * 4/1957 Giovan ..... B68G 5/02 267/145
2,898,975 A * 8/1959 Wagner ..... F16F 3/0873 267/145

(Continued)

FOREIGN PATENT DOCUMENTS

CN 203619154 U 6/2014
CN 203914189 U 11/2014

(Continued)

OTHER PUBLICATIONS

PCT/US2017/035833, filed Jun. 2, 2017; Life Mattress Inc.; International Search Report (ISR) and Written Opinion.

*Primary Examiner* — Myles A Throop
(74) *Attorney, Agent, or Firm* — Renaissance IP Law Group, LLP; David A. Crowther

(57) ABSTRACT

A configurable foam mattress comfort system includes a firm foam mattress foundation including an upper surface having a triangular grooves disposed across a width thereof, and foam elongate cells configured to fit partially within corresponding triangular grooves from among the triangular grooves disposed across the width thereof. A length of each of the foam elongate cells is substantially equal to the width of the firm foam mattress foundation. The foam elongate cells are configured to be custom-stacked on each other and on the firm foam mattress foundation in accordance with a user's desired comfort configuration.

18 Claims, 19 Drawing Sheets

(56) References Cited

U.S. PATENT DOCUMENTS 2,953,195 A * 9/1960 Turck, Jr. ..... A47C 27/15 267/145
3,047,282 A * 7/1962 Hardy ..... B29K 2075/00 267/145
3,222,697 A * 12/1965 Scheermesser ..... A47C 27/144 428/160
3,319,274 A * 5/1967 Upton ..... A47C 27/144 5/701
3,534,417 A 10/1970 Boyles
4,275,473 A * 6/1981 Poirier ..... A47C 27/146 441/128
4,809,375 A * 3/1989 Bull ..... A47C 21/048 5/722
4,901,387 A * 2/1990 Luke ..... A47C 27/146 5/727
5,136,741 A * 8/1992 Balonick ..... A47C 27/001 5/699
5,414,882 A * 5/1995 Goodale ..... A47C 31/105 2/86
5,819,349 A 10/1998 Schwartz
7,370,380 B2 * 5/2008 DeFranks ..... A47C 27/00 5/483
7,571,504 B2 8/2009 Kuo
7,757,322 B2 * 7/2010 An ..... A47C 27/056 5/722
7,954,189 B2 6/2011 Rawls-Meehan
8,020,230 B2 9/2011 Rawls-Meehan
8,347,588 B2 1/2013 Oh
9,986,846 B1 * 6/2018 Davis ..... A47C 31/105
2005/0028275 A1 2/2005 Hooper
2005/0055778 A1 * 3/2005 Kuchel ..... A47C 27/056 5/716
2006/0260060 A1 * 11/2006 Apperson ..... A47C 27/146 5/691
2008/0229507 A1 9/2008 Healy
2011/0072587 A1 * 3/2011 Cao ..... A47C 27/144 5/655.9
2011/0271447 A1 11/2011 Theosabrata
2013/0152305 A1 6/2013 Lall
2014/0251219 A1 9/2014 Rawls-Meehan
2016/0058203 A1 3/2016 Yaacoby
2016/0353907 A1 * 12/2016 Lava ..... A47C 27/001

FOREIGN PATENT DOCUMENTS

EP 0390982 10/1990
JP 2006346218 A 12/2006
JP 2009279086 A 12/2009
WO 1995022272 A1 8/1995

* cited by examiner

CONFIGURABLE FOAM COMFORT SYSTEM

RELATED APPLICATION DATA

This application is a continuation in part of U.S. application Ser. No. 15/611,561, filed on Jun. 1, 2017, which claims the benefit of U.S. Provisional Patent Application Ser. No. 62/345,503, filed on Jun. 3, 2016, which are hereby incorporated by reference.

TECHNICAL FIELD

This application pertains to foam mattresses, and more particularly, to a configurable foam comfort system.

BACKGROUND

People spend more time on their mattresses than anywhere else. This includes periods of relaxation, sleep, watching television, surfing the web, among other activities. Mattresses have become integral to nearly every person's life in our modern world of comforts and conveniences. Yet, while the materials used to construct mattresses have improved over time, the quality of mattresses varies widely, and even the best-quality conventional mattresses are nonetheless lacking in one or more areas such as comfort, configurability, or price point.

Accordingly, a need remains for an improved mattress, and in particular, a need remains for a configurable foam comfort system. Embodiments of the inventive concept address these and other limitations in the prior art.

The foregoing and other features of the inventive concept will become more readily apparent from the following detailed description, which proceeds with reference to the accompanying drawings.

DETAILED DESCRIPTION OF THE EMBODIMENTS

Reference will now be made in detail to embodiments of the inventive concept, examples of which are illustrated in the accompanying drawings. The accompanying drawings are not necessarily drawn to scale. In the following detailed description, numerous specific details are set forth to enable a thorough understanding of the inventive concept. It should be understood, however, that persons having ordinary skill in the art may practice the inventive concept without these specific details. In other instances, well-known methods, procedures, components, circuits, and networks have not been described in detail so as not to unnecessarily obscure aspects of the embodiments.

It will be understood that, although the terms first, second, etc. may be used herein to describe various elements, these elements should not be limited by these terms. These terms are only used to distinguish one element from another. For example, a first foam layer could be termed a second foam layer, and, similarly, a second foam layer could be termed a first foam layer, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

The terminology used in the description of the inventive concept herein is for the purpose of describing particular embodiments only and is not intended to be limiting of the inventive concept. As used in the description of the inventive concept and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Figure 1:
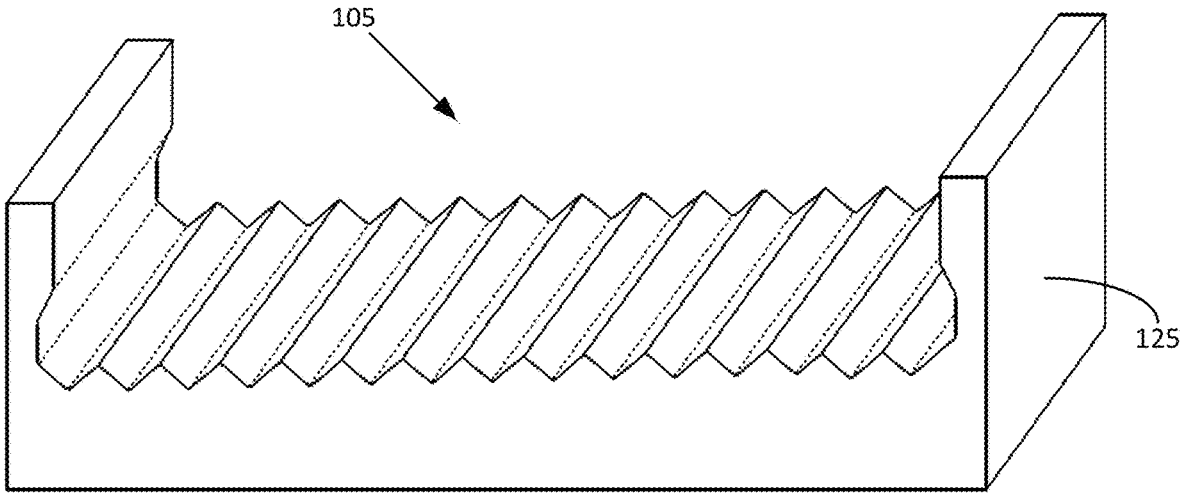
FIG. 1 illustrates an example perspective view of a firm foam mattress foundation of a configurable foam comfort system in accordance with various embodiments of the present inventive concept.
Figure 2:
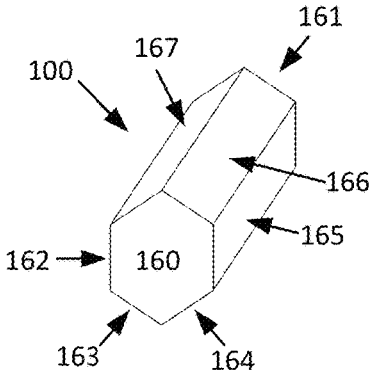
FIG. 2 illustrates an example foam hexagonal cell configurable on the firm foam mattress foundation of FIG. 1.
Figure 3:
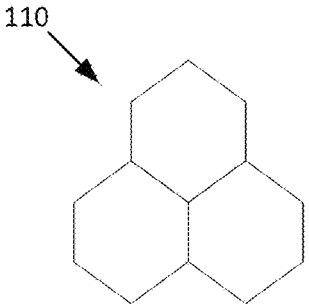
FIG. 3 illustrates multiple foam hexagonal cells in a stacked configuration in accordance with various embodiments of the present inventive concept.

FIG. 1 illustrates an example perspective view of a firm foam mattress foundation 105 of a configurable foam comfort system in accordance with various embodiments of the present inventive concept. FIG. 2 illustrates an example foam hexagonal cell 100 configurable on the firm foam mattress foundation 105 of FIG. 1. FIG. 3 illustrates multiple foam hexagonal cells 100 in a stacked honeycomb configuration 110 in accordance with various embodiments of the present inventive concept. Reference is now made to FIGS. 1 through 3.

The foam hexagonal cells 100 can lay horizontally on the firm foam mattress foundation 105. The foam hexagonal cells 100 can be stacked so they fit together in a honeycomb configuration as shown in the configuration 110. As such, the foam hexagonal cells 100 can be quickly and easily fit together in a non-shifting and stable arrangement. The horizontal cells 100 create a nesting-like pattern that supports each of the surrounding cells 100. Thus, the surrounding cells 100 in any particular configuration can directly support each near-by cell 100.

Each of the foam hexagonal cells 100 can include a first hexagonal face side 160 and a second hexagonal face side 161 opposite thereof. In addition, the foam hexagonal cells 100 can each include a first side wall 162, a second sidewall 163, a third sidewall 167, a fourth sidewall 165, a fifth sidewall 164, and a sixth sidewall 166. Each of the foam hexagonal cells 100 can be an elongate having a length that is substantially equal to a width of the firm foam mattress foundation 105.

The firm foam mattress foundation 105 can include form-fit walls 125, which are cut or otherwise formed so that they conform to the shape of the hexagonal cells 100, as further described below. This provides a secure and stable configuration of the foam hexagonal cells 100 within and on the firm foam mattress foundation 105.

The foam hexagonal cells 100 can have three different foam characteristics: 1) firm, 2) medium firm, and 3) soft. This allows a user to create a personalized support level by arranging the foam hexagonal cells 100 in various configurations depending on the characteristics of the cells. For example, firmer cells can be placed in the middle of the mattress foundation 105 to support the back, while softer cells can be placed near the area where the head rests. The shape of the configurable foam comfort system is modular and can be adjusted based on how many cells 100 are stacked in a given region. The cells 100 can be rearranged to create a customized comfort level and shape.

Moreover, individual hexagonal cells 100 can be replaced if warn or defective. For example, if the mid-section of the configurable foam comfort system creates a "sag" the user can swap cells in the mid-section with cells from other sections of the mattress that don't have any significant load baring need, such as the foot section. The structure of the foam hexagonal cells 100 allows the user to replace or repair broken-down components within the mattress foundation 105. In doing so, life of the mattress is extended. And for those components that must be replaced entirely, the manufacture can send smaller pieces of foam, instead of having to replace the entire sheet of foam, because of the modular design of the foam comfort system.

Moreover, the multiple density foams in the foam hexagonal cells 100 can provide different comfort levels. The surrounding cells of a particular cell can directly affect each cell. The multiple density or firmness levels of the cells 100 allows the user to create many different comfort levels by positioning and arranging the cells in unique orders and configurations.

Figure 4:
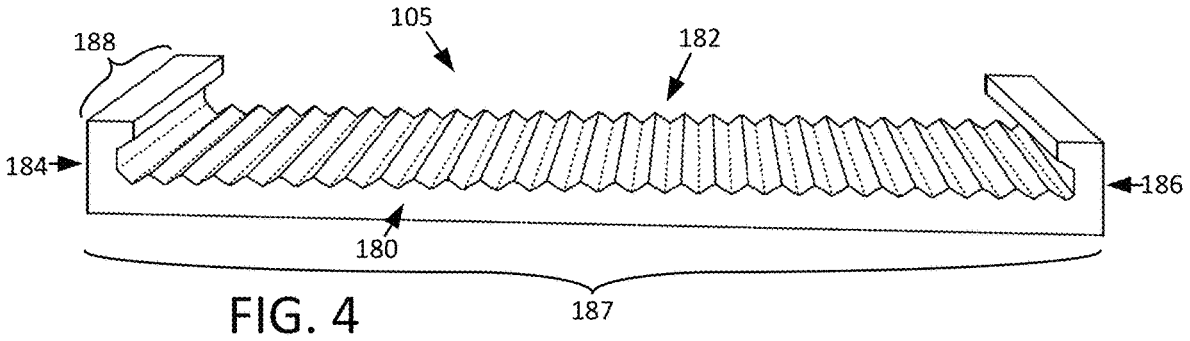
FIG. 4 illustrates another example perspective view of a firm foam mattress foundation of a configurable foam comfort system in accordance with various embodiments of the present inventive concept.
Figure 5:
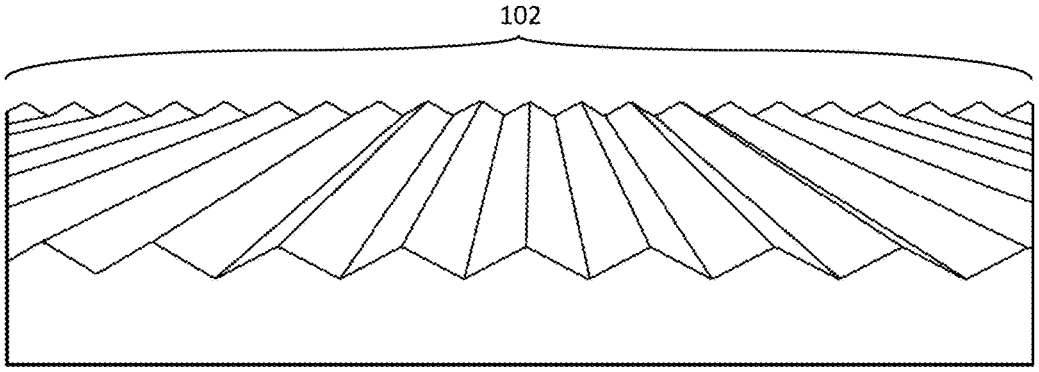
FIG. 5 illustrates triangular grooves in the firm foam mattress foundation of FIG. 4.
Figure 6:
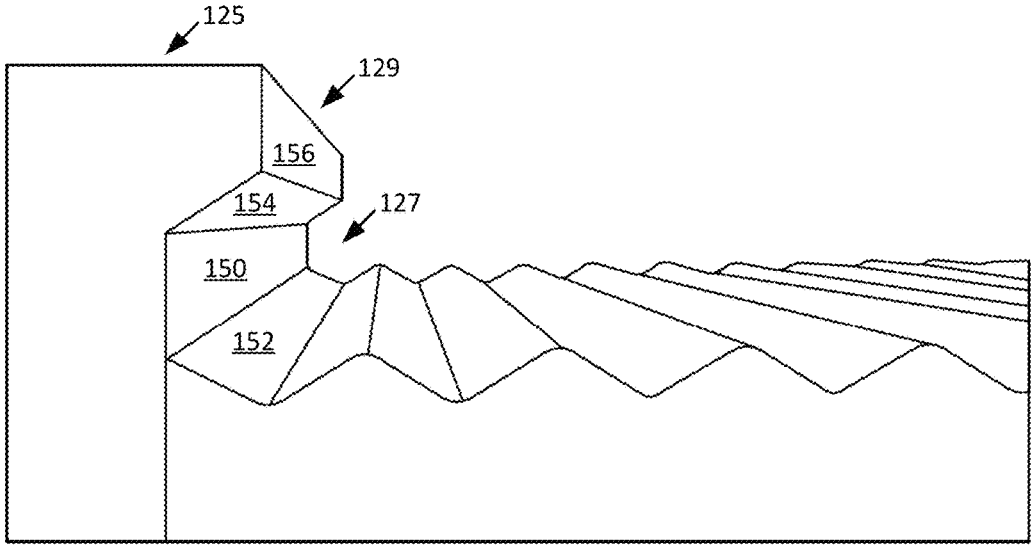
FIG. 6 illustrates a form-fit wall of the firm foam mattress foundation of FIG. 4.

FIG. 4 illustrates another example perspective view of a firm foam mattress foundation 105 of a configurable foam comfort system in accordance with various embodiments of the present inventive concept. FIG. 5 illustrates triangular grooves 102 in the firm foam mattress foundation 105 of FIG. 4. FIG. 6 illustrates a form-fit wall 125 of the firm foam mattress foundation of FIG. 4. Reference is now made to FIGS. 4 through 6.

The firm foam mattress foundation 105 can include any suitable number of triangular grooves 102. For example, the firm foam mattress foundation 105 can include an upper surface having a plurality of triangular grooves 102 disposed across a width thereof. Each of the triangular grooves 102 can provide a base for a corresponding foam hexagonal cell 100. In some embodiments, every triangular groove 102 is occupied by a corresponding foam hexagonal cell 100. In some embodiments, a subset of the total triangular grooves 102 is occupied by a corresponding foam hexagonal cell 100, and a remaining subset is unoccupied. Because the cell points of the foam hexagonal cells 100 face upwards and downwards, the triangular grooves 102 prevent the foam hexagonal cells 100 from moving around or shifting. With the vertical apex points of the foam hexagonal cells 100 facing upwards, additional foam pieces can be added to the structure in the event of a major repair on the base mattress foundation 105. In other words, the ^^^^^ shape allows similar shapes to be used to fit within the ^^^^^ groves to give the mattress a non-shifting surface. The additional pieces can have a base that looks like vvvvv, and can fit together such that they are prevented from shifting.

The form-fit wall 125 can include a nook 127 and an overhang portion 129. The nook 127 can be configured to easily receive and fit a foam hexagonal cell 100. The overhang portion 129 can partially overhang and secure the foam hexagonal cell 100 in place, but without creating an undue burden to rearrangement of the cells. Accordingly, the nook 127 and the overhang 129 of the form-fit wall 125 can provide stability to the foam hexagonal cells 100, particularly on the ends of the configurable foam comfort system, but without impeding the ease of reconfiguration of the foam hexagonal cells 100.

The nook 127 can receive and fit a particular foam hexagonal elongate cell 100. The overhang portion 129 can partially overhang and secure the particular foam hexagonal elongate cell 100 in place. The nook 127 can include a vertical side wall 150, a lower wall 152 oriented obliquely relative to the vertical side wall 150, and an upper wall 154 oriented obliquely relative to the vertical side wall 150. The overhang portion 129 can include a vertical side wall 156 and the upper wall 154 of the nook 127. The vertical side wall 150 of the nook 127 can make contact with a first side wall (e.g., 162 of FIG. 2) of the particular foam hexagonal elongate cell 100. The lower wall 152 of the nook 127 can make contact with a second side wall (e.g., 163 of FIG. 2) of the particular foam hexagonal elongate cell 100. The upper wall 154 of the nook 127 can make contact with a third side wall (e.g., 167 of FIG. 2) of the particular foam hexagonal elongate cell 100. The vertical side wall 156 of the overhang portion 129 can make contact with a first side wall (e.g., 162 of FIG. 2) of a different foam hexagonal elongate cell 100.

The firm foam mattress foundation 105 includes a first side 180 and a second side 182. The width 188 of the firm foam mattress foundation 105 extends from the first side 180 to the second side 182. The firm foam mattress foundation 105 includes a third side 184 and a fourth side 186. A length of the firm foam mattress foundation 105 extends from the third side 184 to the fourth side 186.

The third side 184 of the firm foam mattress foundation 105 can include a first form-fit wall (e.g., 125) which can conform to a shape of each of the foam hexagonal elongate cells 100. The fourth side 186 of the firm foam mattress foundation 105 can include a second form-fit wall (e.g., 125) which conforms to a shape of each of the foam hexagonal elongate cells 100.

Figure 7:
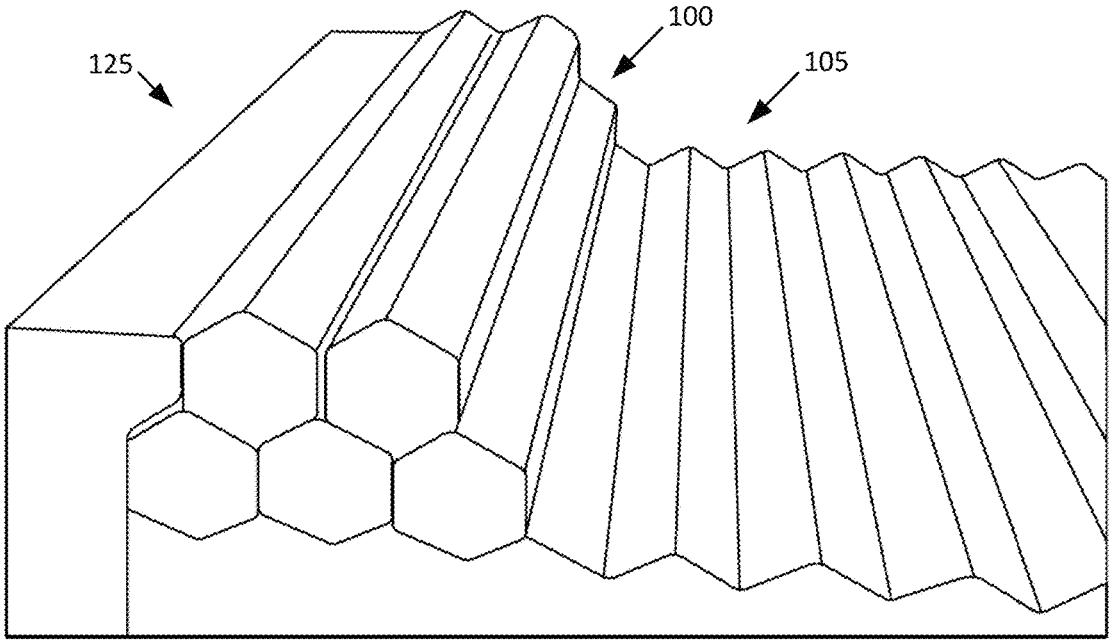
FIG. 7 illustrates an example perspective view of multiple foam hexagonal cells in a stacked configuration toward one end of and atop the firm foam mattress foundation of FIG. 4.
Figure 8:
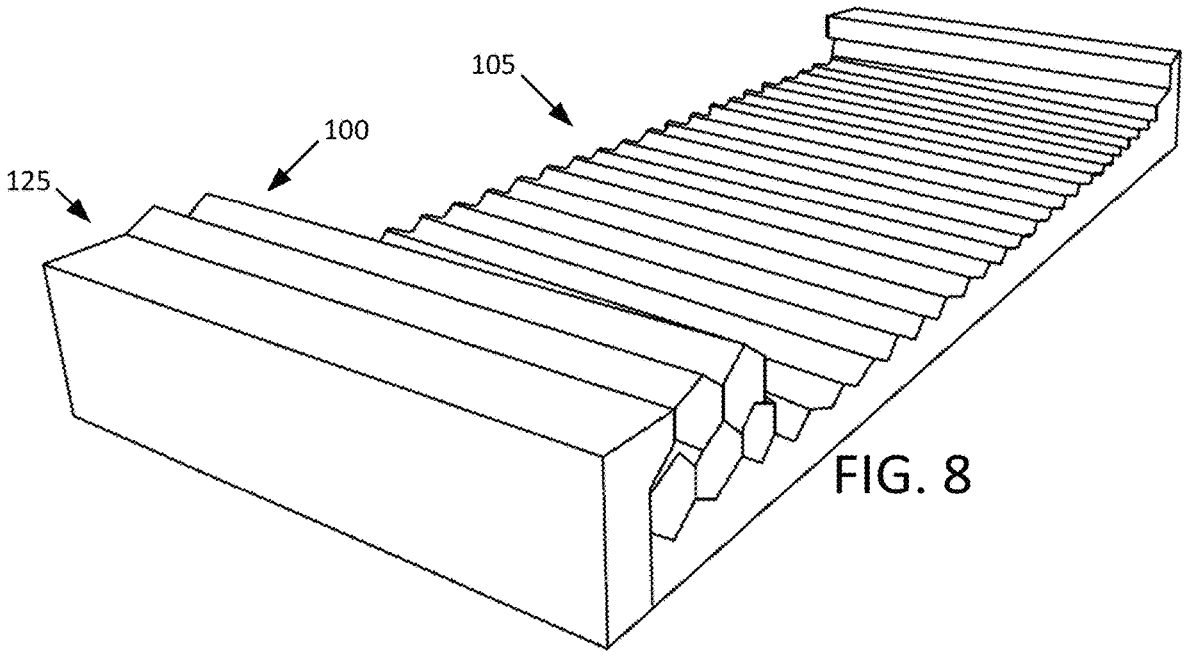
FIG. 8 illustrates another example perspective view of multiple foam hexagonal cells in a stacked configuration toward the one end of and atop the firm foam mattress foundation of FIG. 4.
Figure 9:
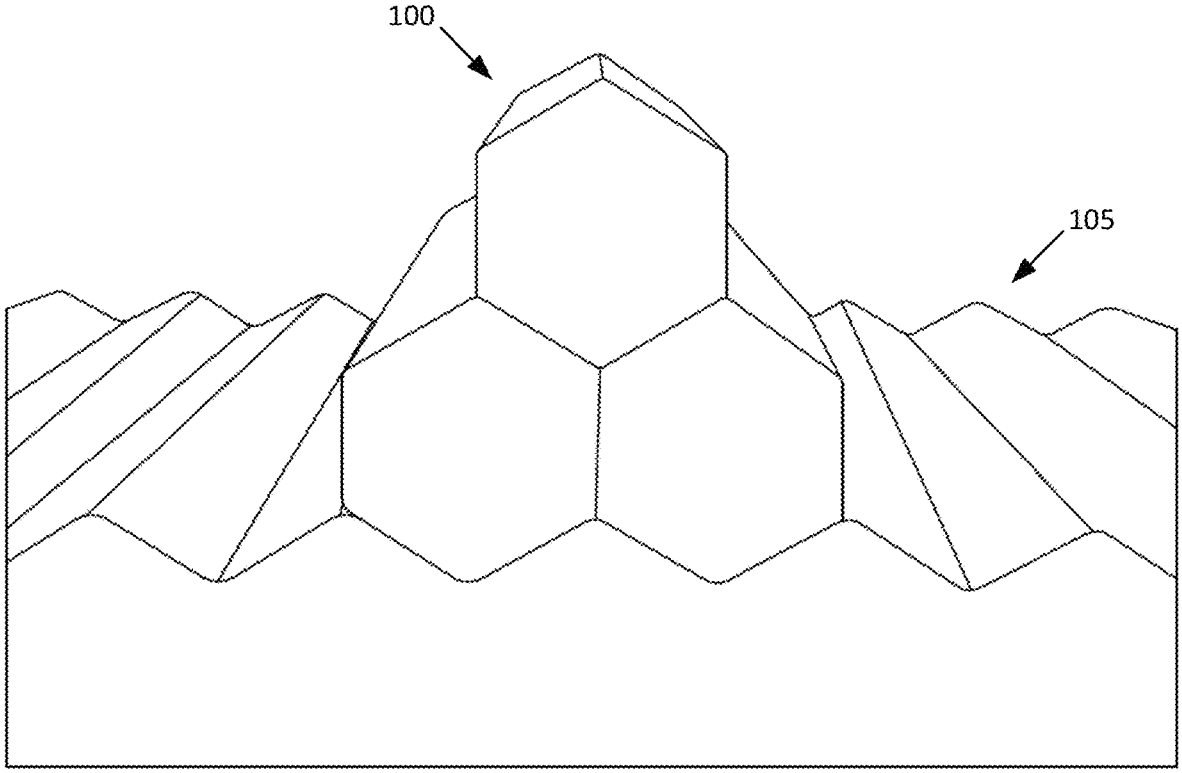
FIG. 9 illustrates an example perspective view of multiple foam hexagonal cells in a stacked configuration in a central region of and atop the firm foam mattress foundation of FIG. 4.

FIG. 7 illustrates an example perspective view of multiple foam hexagonal cells 100 in a stacked configuration toward one end of and atop the firm foam mattress foundation 105 of FIG. 4. FIG. 8 illustrates another example perspective view of multiple foam hexagonal cells 100 in a stacked configuration toward the one end of and atop the firm foam mattress foundation 105 of FIG. 4. FIG. 9 illustrates an example perspective view of multiple foam hexagonal cells 100 in a stacked configuration in a central region of and atop the firm foam mattress foundation 105 of FIG. 4. Reference is now made to FIGS. 7 through 9.

As shown in these figures, the foam hexagonal cells 100 fit snuggly against the form-fit wall 125. Each of the foam hexagonal cells 100 has a length that substantially matches a width of the firm foam mattress foundation 105. In other words, face sides of the foam hexagonal cells 100 are substantially flush with sides of the firm foam mattress foundation 105. Although shown as stacked two-deep, it will be understood that the foam hexagonal cells 100 can be stacked one-deep, two-deep, three-deep, four-deep, five-deep, or more, or even zero-deep, depending on the desired mattress contours of the user. Accordingly, the configurable foam comfort system provides a configurable shape based on the preferences of the user.

The configurable foam comfort system can include multiple foam hexagonal elongate cells 100 configured to fit partially within corresponding triangular grooves (e.g., 102) disposed across the width of the firm foam mattress foundation 105. In some embodiments, a length of each of the foam hexagonal elongate cells 100 is substantially equal to the width of the firm foam mattress foundation 105. The foam hexagonal elongate cells 100 are configured to be custom-stacked on each other and on the firm foam mattress foundation 105 in accordance with a user's desired comfort configuration.

Figure 10:
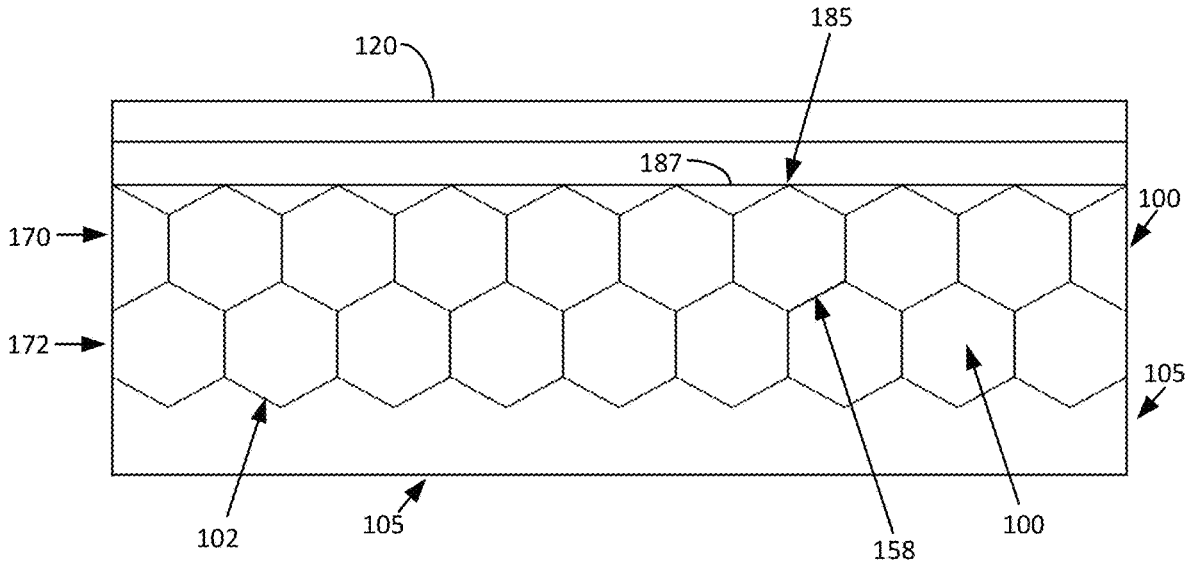
FIG. 10 illustrates multiple foam hexagonal cells in a uniform stacked configuration atop the firm foam mattress foundation of FIG. 4, along with multiple top layers disposed on the foam hexagonal cells in accordance with various embodiments of the present inventive concept.

FIG. 10 illustrates multiple foam hexagonal cells 100 in a uniform stacked configuration atop the firm foam mattress foundation 105, along with multiple top layers 120 disposed on the foam hexagonal cells 100 in accordance with various embodiments of the present inventive concept. Although multiple top layers 120 are shown, it will be understood that one or more top layers 120 can be disposed atop the hexagonal cells 100 and the firm foam mattress foundation 105. The one or more top layers 120 can include memory foam and/or latex materials. As described above, the foam hexagonal cells 100 can be arranged with different cells having different firmness characteristics in different sections of the configurable foam comfort system. The base mattress foundation 105 supports any suitable number of foam layers 120 on top of the customized foam hexagonal cell configuration, thereby providing a unique base configuration and shape according to the preferences of the user.

The foam hexagonal elongate cells 100 can include a first plurality of foam hexagonal elongate cells (e.g., 172) and a second plurality of foam hexagonal elongate cells (e.g., 170) configured to fit atop the first plurality of foam hexagonal elongate cells 172. The first plurality of foam hexagonal elongate 172 cells and the second plurality of foam hexagonal elongate cells 170 can form a honeycomb pattern when viewed from the side.

The first plurality of foam hexagonal elongate cells 172 collectively form an upper surface having a plurality of triangular grooves 158. The second plurality of foam hexagonal elongate cells 170 are configured to fit partially within corresponding triangular grooves 158 of the upper surface of the first plurality of foam hexagonal elongate cells 172.

The first plurality of foam hexagonal elongate cells 172 are configured to extend horizontally from the first side (e.g., 180 of FIG. 4) to the second side (e.g., 182 of FIG. 4) of the firm foam mattress foundation 105 when the first plurality of foam hexagonal elongate cells 172 are fit partially within the corresponding triangular grooves 102 disposed across the width of the firm foam mattress foundation 105. The second plurality of foam hexagonal elongate cells 170 are configured to extend horizontally from the first side 180 to the second side 182 of the firm foam mattress foundation 105 when the second plurality of foam hexagonal elongate cells 170 are fit partially within the corresponding triangular grooves 158 of the upper surface of the first plurality of foam hexagonal elongate cells 172. In some embodiments, each of the second plurality of foam hexagonal elongate cells 170 have a length that is substantially equal to the width (e.g., 188 of FIG. 4) of the firm foam mattress foundation 105.

In some embodiments, one or more rectangular foam top layers 120 are disposed atop a plurality of foam hexagonal elongate cells 170. The one or more rectangular foam top layers 120 can each include a planar upper surface and a planar lower surface. The planar lower surface (e.g., 187) can be in contact with an apex 185 of each of the plurality of foam hexagonal elongate cells 170. In some embodiment, the one or more rectangular foam top layers 120 include a first foam top layer and a second foam top layer disposed atop the first foam top layer. At least one of the first foam top layer or the second foam top layer can include or otherwise be constructed from memory foam.

Figure 11:
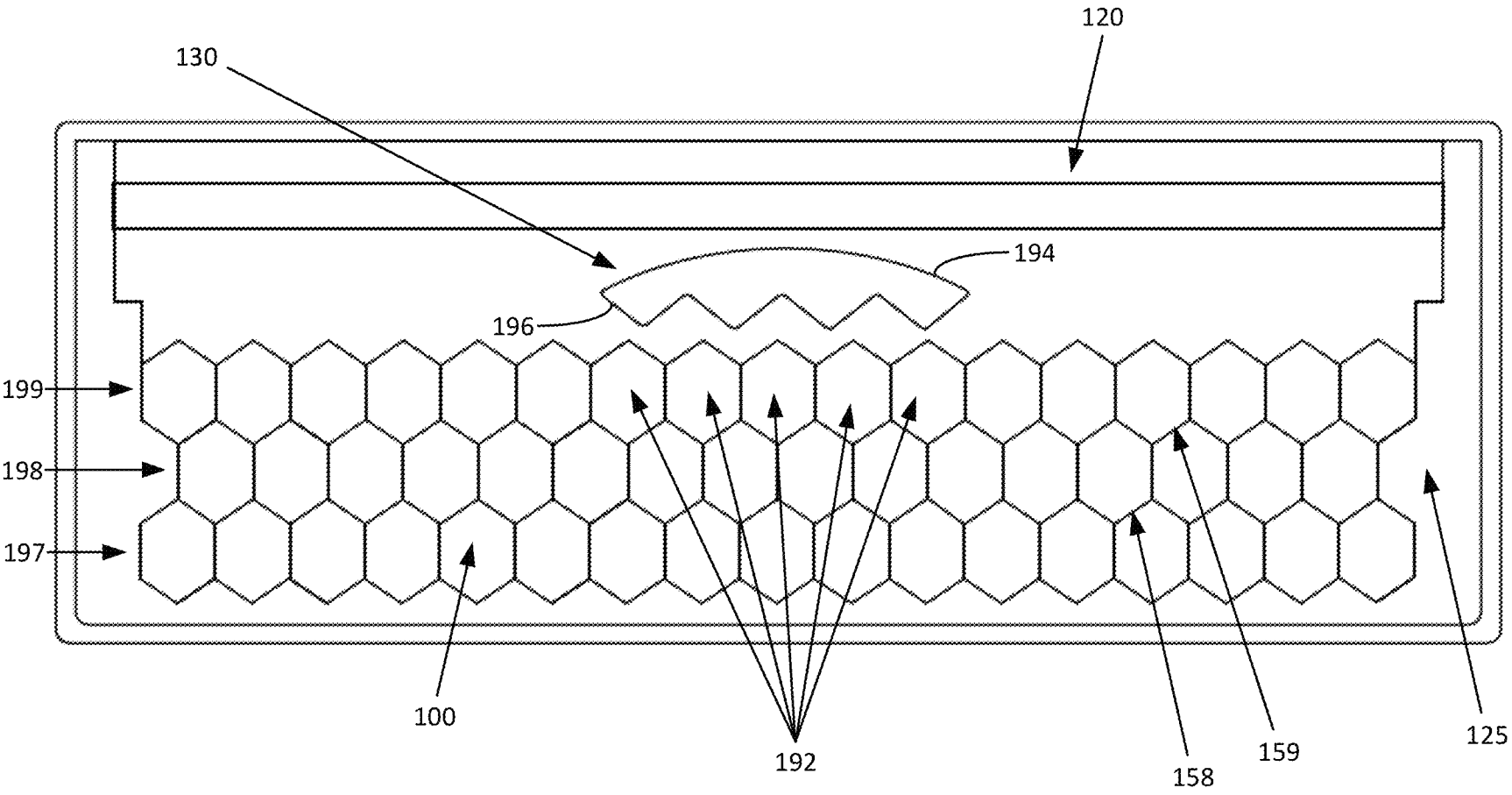
FIG. 11 illustrates multiple foam hexagonal cells in a uniform stacked configuration with a foam body support section disposed over a subset of the foam hexagonal cells to provide a raised arcuate upper surface section in accordance with various embodiments of the present inventive concept.

FIG. 11 illustrates multiple foam hexagonal cells 100 in a uniform stacked configuration with a foam body support section 130 disposed over a subset of the foam hexagonal cells 100 to provide a raised arcuate upper surface section in accordance with various embodiments of the present inventive concept. The foam body support section 130 can be disposed atop the foam hexagonal cells 100 to provide a raised arcuate upper surface section 194 in any suitable location according to the preferences of the user. The foam body support section 130 can provide support for parts of a human body, such as a human head, a human back, human legs, or human feet. The length of the foam body support section 130 can extend width-wise horizontally from one side of the foam mattress foundation to another. Alternatively, the length of the foam body support section 130 can be less than the width of the foam mattress foundation.

The foam body support section 130 can be disposed atop a subset (e.g., 192) of foam hexagonal elongate cells 100 and under the one or more rectangular foam top layers 120. In some embodiments, the foam body support section 130 includes a raised arcuate upper surface section 194. The subset 192 of foam hexagonal elongate cells 100 can collectively form an upper surface having a plurality of triangular grooves. The foam body support section 130 can include a lower section 196 having a plurality of triangular grooves configured to fit together with the triangular grooves of the upper surface of the subset 192 of foam hexagonal elongate cells 100.

The configurable foam mattress comfort system can include various layers (e.g., 197, 198, and 199) of foam hexagonal elongate cells 100. Each layer of hexagonal elongate cells 100 are configured to extend horizontally from the first side to the second side of the firm foam mattress foundation 105. The top layer 199 is configured to fit partially within corresponding triangular grooves 159 of an upper surface of the middle layer 198 of foam hexagonal elongate cells 100. The middle layer 198 is configured to fit partially within corresponding triangular grooves 158 of an upper surface of the lower layer 198 of foam hexagonal elongate cells 100. A combination of the first, the second, and the third layers of foam hexagonal elongate cells is rearrangeable to create a customized comfort level and shape.

One or more foam hexagonal elongate cells from among the bottom layer 197, the middle layer 198, and the top layer 199 of foam hexagonal elongate cells 100 can include a first firmness characteristic such as firm. One or more foam hexagonal elongate cells from among the bottom layer 197, the middle layer 198, and the top layer 199 of foam hexagonal elongate cells 100 can include a second firmness characteristic such as medium firm. One or more foam hexagonal elongate cells from among the bottom layer 197, the middle layer 198, and the top layer 199 of foam hexagonal elongate cells 100 can include a third firmness characteristic such as soft.

Figure 12:
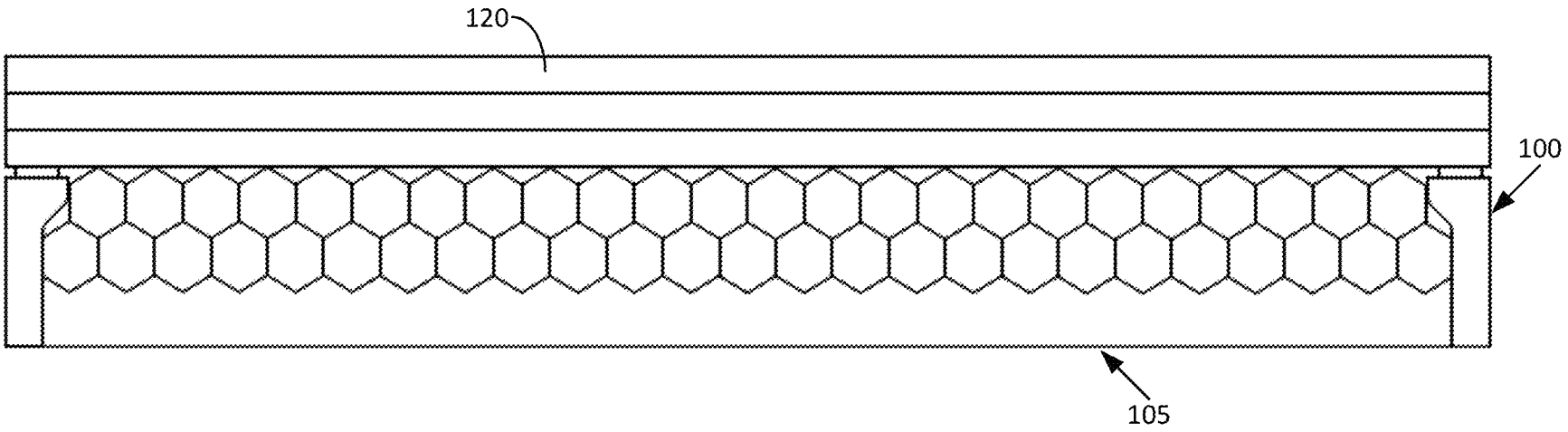
FIG. 12 illustrates an example side elevation view of multiple foam hexagonal cells in a uniform stacked configuration filling a firm foam mattress foundation in accordance with various embodiments of the present inventive concept.
Figure 13:
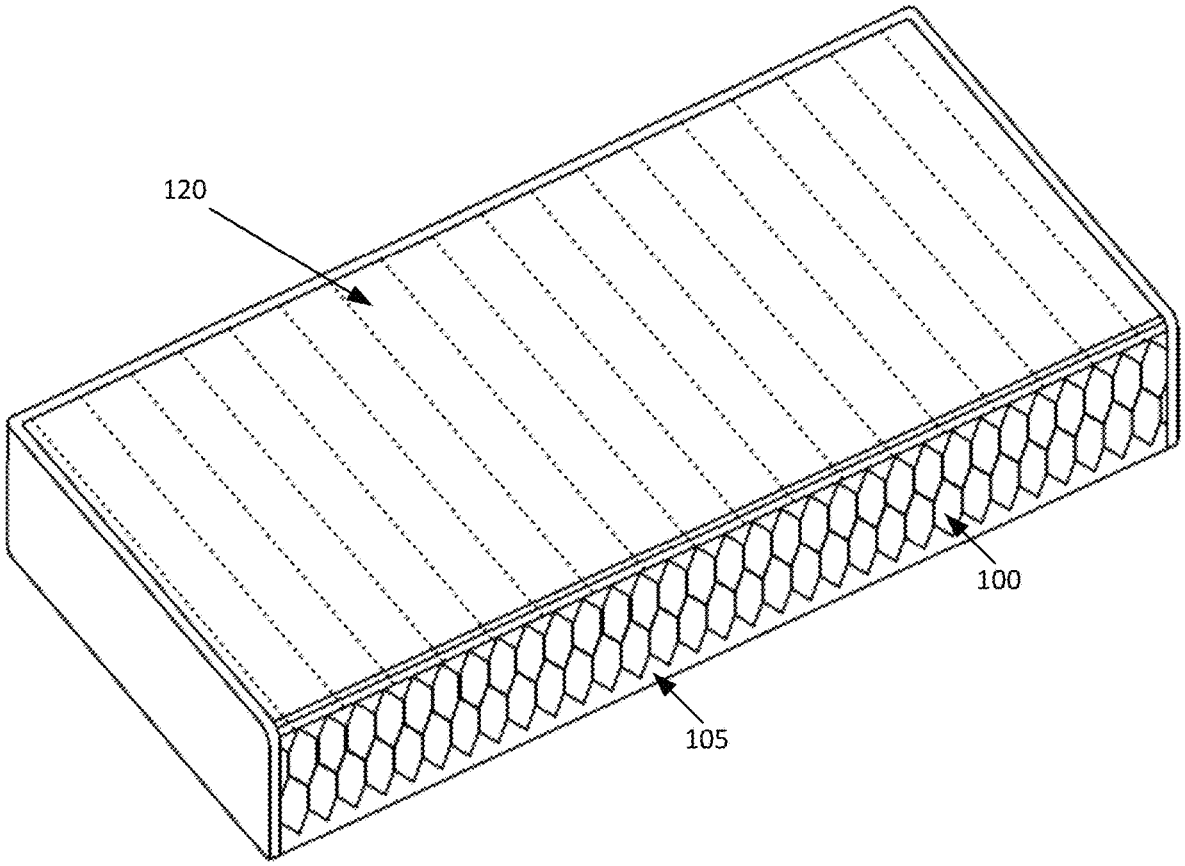
FIG. 13 illustrates an example perspective view of multiple foam hexagonal cells in a uniform stacked configuration filling a firm foam mattress foundation in accordance with various embodiments of the present inventive concept.

FIG. 12 illustrates an example side elevation view of multiple foam hexagonal cells 100 in a uniform stacked configuration filling a firm foam mattress foundation 105 in accordance with various embodiments of the present inventive concept. FIG. 13 illustrates an example perspective view of multiple foam hexagonal cells 100 in a uniform stacked configuration filling a firm foam mattress foundation 105 in accordance with various embodiments of the present inventive concept. Reference is now made to FIGS. 12 through 13.

One or more top layers 120 can be disposed atop the hexagonal cells 100 and the firm foam mattress foundation 105. The one or more top layers 120 can include memory foam and/or latex materials. The configurable foam comfort system can include the firm foam mattress foundation 105, the foam hexagonal cells 100, and the one or more top layers 120.

Figure 14:
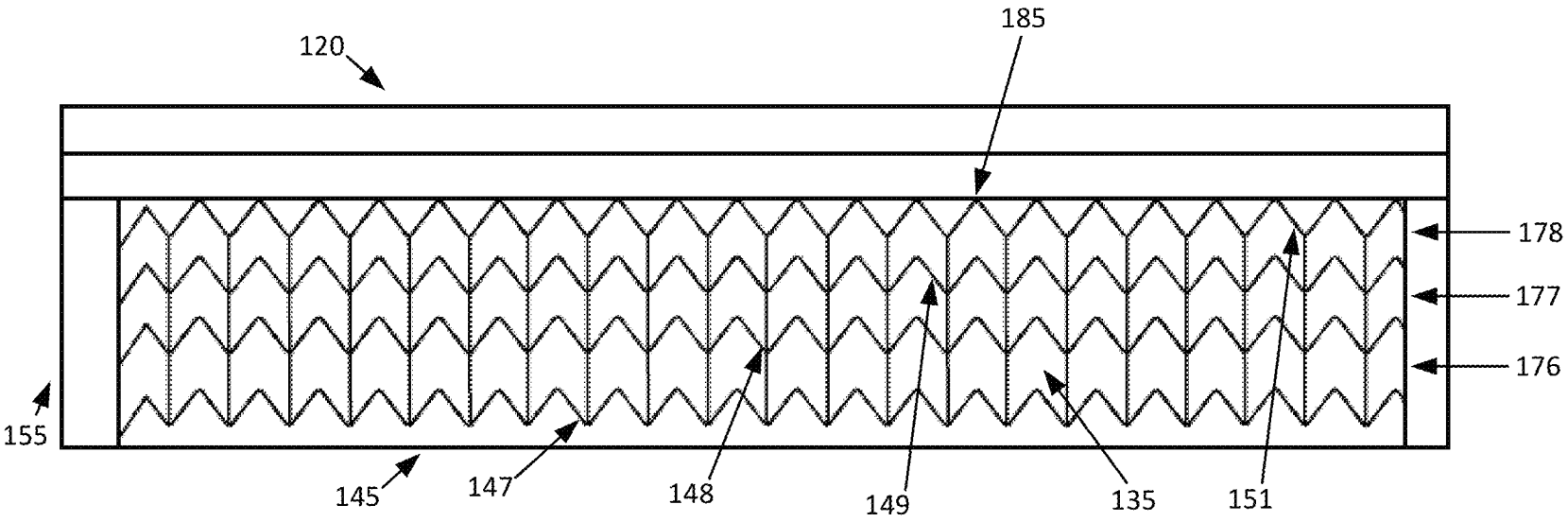
FIG. 14 illustrates an example side elevation view of a configurable foam comfort system including multiple stacked foam 'M' shaped cells atop a firm foam mattress foundation, with multiple top layers thereon, in accordance with various embodiments of the present inventive concept.
Figure 15:
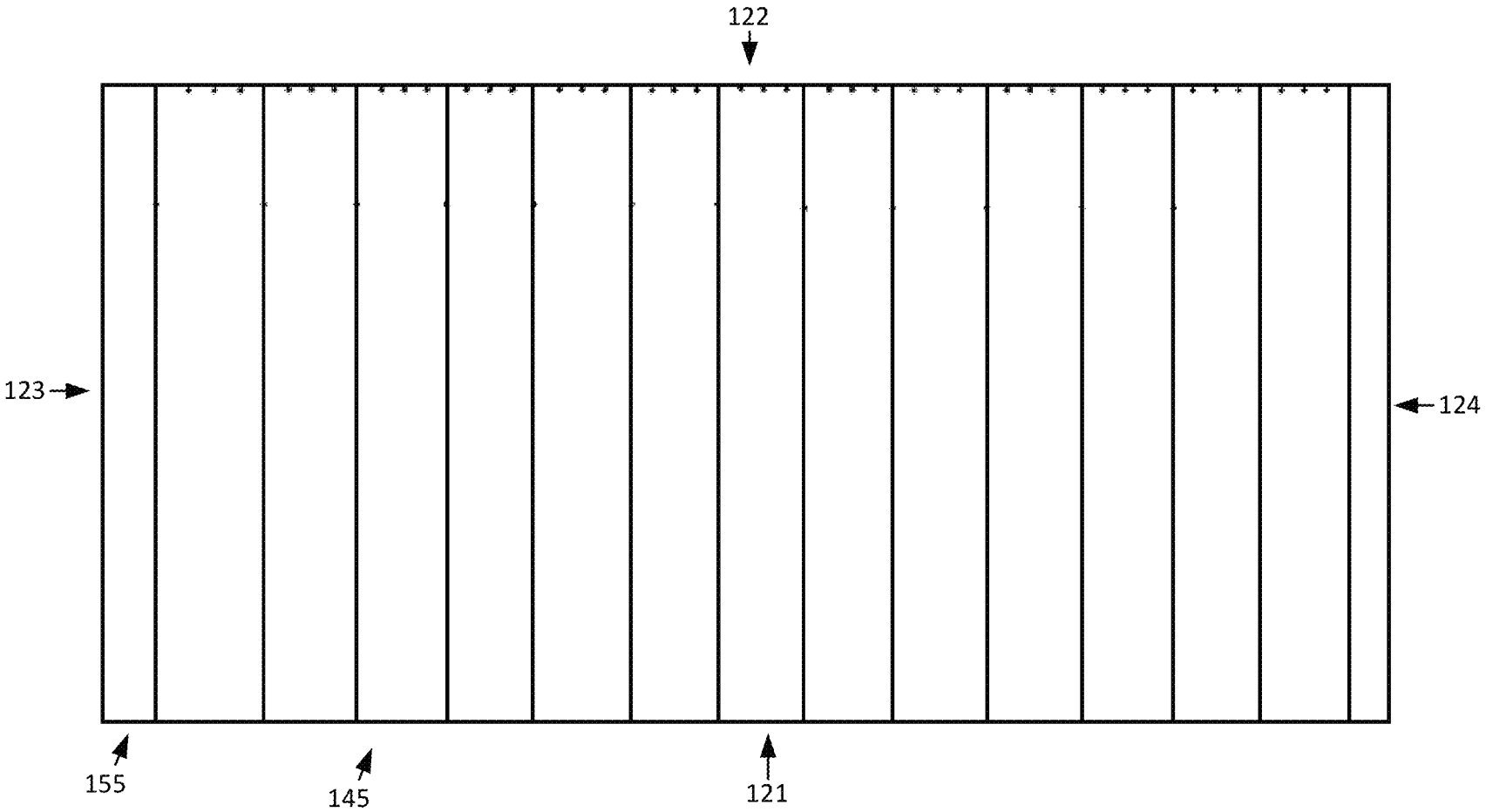
FIG. 15 illustrates a top view of the configurable foam comfort system of FIG. 14.
Figure 16:
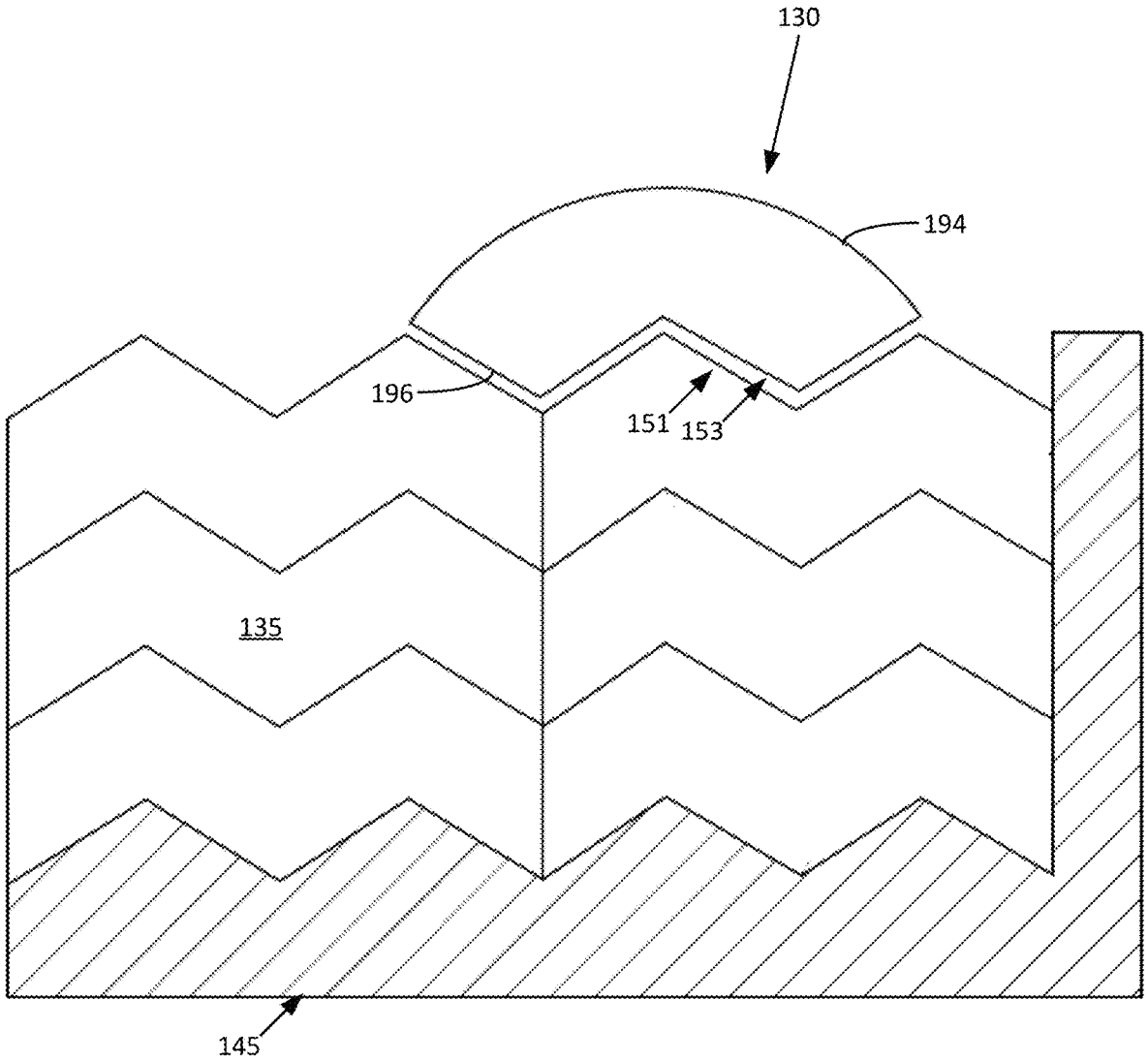
FIG. 16 illustrates a close-up view of the stacked foam 'M' shaped cells, along with a foam body support section to provide a raised arcuate upper surface section, in accordance with various embodiments of the present inventive concept.

FIG. 14 illustrates an example side elevation view of a configurable foam comfort system including multiple stacked foam 'M' shaped cells 135 atop a firm foam mattress foundation 145, with one or more top layers 120 disposed thereon, in accordance with various embodiments of the present inventive concept. FIG. 15 illustrates a top view of the configurable foam comfort system of FIG. 14. FIG. 16 illustrates a close-up view of the stacked foam 'M' shaped cells 135, along with a foam body support section 130 to provide a raised arcuate upper surface section 194, in accordance with various embodiments of the present inventive concept. Reference is now made to FIGS. 14 through 16.

The foam 'M' shaped cells 135 fit together and provide a non-shifting and stable arrangement, such that the foam 'M' shaped cells 135 can be stacked on top of each other to form a different firmness according to preference, and according to a modular design. The firm foam mattress foundation 145 can include vertical walls 155, which need not be cut to conform to the shape of the 'M' shaped cells 135, since edges of the 'M' shaped cells 135 form a vertical wall themselves. In other words, the 'M' shaped cells 135 can fit against the ends of the firm foam mattress foundation 145 without any nooks or overhangs. This provides a secure and stable configuration of the 'M' shaped cells 135 on the firm foam mattress foundation 145. As shown in FIG. 16, a foam body support section 130 can be added to provide a raised arcuate upper surface section 194. The foam body support section 130 can include an angled underside 196 that fits atop the 'M' shaped cells 135 at any suitable location along the 'M' shaped cells 135.

The firm foam mattress foundation 145 can include an upper surface having a plurality of triangular grooves 147 disposed across a width thereof. A plurality of foam 'M' shaped elongate cells 135 from layer 176 can be configured to fit partially within corresponding triangular grooves 147 disposed across the width thereof. In some embodiments, a length of each of the plurality of foam 'M' shaped elongate cells is substantially equal to the width of the firm foam mattress foundation 145.

In some embodiments, the configurable foam comfort system includes a first layer 176 of foam 'M' shaped elongate cells 135 and a second layer 177 of foam 'M' shaped elongate cells 135 configured to fit atop the first layer of foam 'M' shaped elongate cells. The first layer 176 of foam 'M' shaped elongate cells 135 collectively form an upper surface having a plurality of triangular grooves 148. The second layer 177 of foam 'M' shaped elongate cells 135 are configured to fit partially within corresponding triangular grooves 148 of the upper surface of the first layer 176 of foam 'M' shaped elongate cells 135. The second layer 177 of foam 'M' shaped elongate cells 135 collectively form an upper surface having a plurality of triangular grooves 149. The third layer 178 of foam 'M' shaped elongate cells 135 are configured to fit partially within corresponding triangular grooves 149 of the upper surface of the second layer 177 of foam 'M' shaped elongate cells 135.

The firm foam mattress foundation 145 can include a first side 121 and a second side 122. The width of the firm foam mattress foundation 145 extends from the first side 121 to the second side 122. The firm foam mattress foundation 145 can include a third side 123 and a fourth side 124. A length of the firm foam mattress foundation extends from the third side 123 to the fourth side 124.

The first layer 176 of foam 'M' shaped elongate cells 135 are configured to extend horizontally from the first side 121 to the second side 122 of the firm foam mattress foundation 145 when the first layer 176 of foam 'M' shaped elongate cells 135 are fit partially within the corresponding triangular grooves 147 disposed across the width of the firm foam mattress foundation 145. The second layer 177 of foam 'M' shaped elongate cells 135 are configured to extend horizontally from the first side 121 to the second side 122 of the firm foam mattress foundation 145 when the second layer 177 of foam 'M' shaped elongate cells 135 are fit partially within the corresponding triangular grooves 148 of the upper surface of the first layer 176 of foam 'M' shaped elongate cells 135. The third layer 178 of foam 'M' shaped elongate cells 135 are configured to extend horizontally from the first side 121 to the second side 122 of the firm foam mattress foundation 145 when the third layer 178 of foam 'M' shaped elongate cells 135 are fit partially within the corresponding triangular grooves 149 of the upper surface of the second layer 177 of foam 'M' shaped elongate cells 135.

Each of the second layer 177 of foam 'M' shaped elongate cells 135 have a length that is substantially equal to the width of the firm foam mattress foundation 145. The third side 123 of the firm foam mattress foundation 145 includes a first vertical wall 155, which conforms to a shape of each of the foam 'M' shaped elongate cells 135 from each of the layers 176, 177, and 178. The fourth side 124 of the firm foam mattress foundation 145 includes a second vertical wall 155, which conforms to a shape of each of the foam 'M' shaped elongate cells 135 from each of the layers 176, 177, and 178.

The configurable foam mattress comfort system can further include one or more rectangular foam top layers 120 disposed atop the foam 'M' shaped elongate cells 135. The one or more rectangular foam top layers 120 include a planar upper surface and a planar lower surface. The planar lower surface can be in contact with an apex 185 of each of the foam 'M' shaped elongate cells 135, for example, of the upper layer 178. The one or more rectangular foam top layers 120 can include a first foam top layer and a second foam top layer disposed atop the first foam top layer. At least one of the first foam top layer or the second foam top layer can include memory foam.

The configurable foam mattress comfort system can further include a foam body support section 130 disposed atop a subset of foam 'M' shaped elongate cells 135 and under the one or more rectangular foam top layers 120. The foam body support section 130 can include a raised arcuate upper surface section 194. The foam 'M' shaped elongate cells (e.g., from layer 178) collectively form an upper surface having a plurality of triangular grooves 151. The foam body support section 130 can include a lower section 196 having a plurality of triangular grooves 153 configured to fit together with the plurality of triangular grooves 151 of the upper surface of the layer of plurality of foam 'M' shaped elongate cells 178.

A combination of the first layer 176, the second layer 177, and the third layer 178 of foam 'M' shaped elongate cells 135 is rearrangeable to create a customized comfort level and shape. One or more foam 'M' shaped elongate cells 135 from among the first layer 176, the second layer 177, and the third layer 178 of foam 'M' shaped elongate cells can include a first firmness characteristic, such as firm. One or more foam 'M' shaped elongate cells 135 from among the first layer 176, the second layer 177, and the third layer 178 of foam 'M' shaped elongate cells can include a second firmness characteristic, such as medium firm. One or more foam 'M' shaped elongate cells 135 from among the first layer 176, the second layer 177, and the third layer 178 of foam 'M' shaped elongate cells can include a third firmness characteristic, such as soft. The firm characteristic can indicate a firmness greater than the firmness of medium firm. The soft characteristic can indicate a softness greater than the softness of medium firm.

In some embodiments, the foam cells (e.g., 100 and/or 135) can include an internal air bladder. The pressure of the internal air bladder can be adjusted by the user. An outer material of the foam cells can be impermeable to air. In some embodiments, the user can adjust their comfort without having to get on the mattress. In some embodiments, the user can adjust their comfort level while on the mattress.

Figure 17:
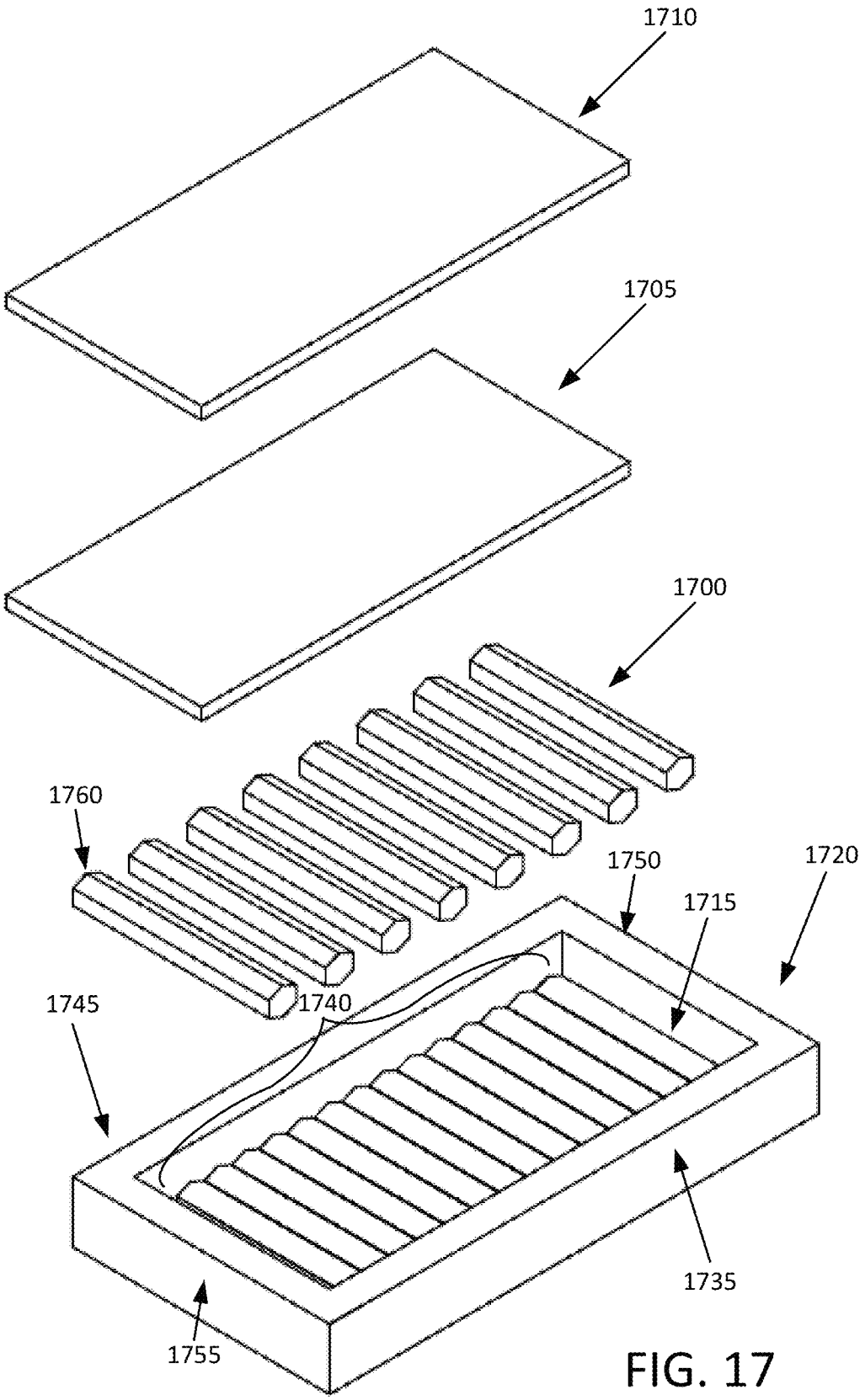
FIG. 17 illustrates an exploded view of a configurable foam mattress comfort system including a firm foam mattress foundation, multiple foam hexagonal cells, and multiple top layers disposed on the foam hexagonal cells in accordance with various embodiments of the present inventive concept.

FIG. 17 illustrates an exploded view of a configurable foam mattress comfort system including a firm foam mattress foundation 1720, multiple foam hexagonal cells 1700, and multiple top layers (e.g., 1705 and 1710) disposed on the foam hexagonal cells 1700 in accordance with various embodiments of the present inventive concept.

The configurable foam mattress comfort system can include the foam mattress foundation 1720 including an upper surface 1715 having triangular grooves 1740 disposed across a width thereof. The configurable foam mattress comfort system can include foam hexagonal elongate cells 1700 configured to fit partially within corresponding triangular grooves from among the triangular grooves 1740 disposed across the width thereof. The foam mattress foundation 1720 can include a first side 1735 and a second side 1745. The width of the foam mattress foundation 1720 can extend from the first side 1735 to the second side 1745. The foam mattress foundation 1720 can include a third side 1750 and a fourth side 1755. A length of the foam mattress foundation 1720 can extend from the third side 1750 to the fourth side 1755.

The foam hexagonal elongate cells 1700 can be configured to extend horizontally from the first side 1735 to the second side 1745 of the foam mattress foundation 1720 when the foam hexagonal elongate cells 1700 are fit partially within the corresponding triangular grooves from among the triangular grooves 1740 disposed across the width of the foam mattress foundation 1720. The configurable foam mattress comfort system can further include one or more rectangular foam top layers (e.g., 1705 and 1710) disposed atop the foam hexagonal elongate cells 1700. The one or more rectangular foam top layers (e.g., 1705 and 1710) can be made of or otherwise include memory foam. The one or more rectangular foam top layers (e.g., 1705 and 1710) can include a planar upper surface and a planar lower surface. In some embodiments, the planar lower surface of the rectangular foam top layer 1705 is in contact with an apex (e.g., 1760) of each of the foam hexagonal elongate cells 1700.

The foam hexagonal elongate cells 1700 can be custom-stacked on each other and on the foam mattress foundation 1720 in accordance with a user's desired comfort configuration. When placed on the foam mattress foundation 1720, the foam hexagonal elongate cells 1700 collectively form an upper surface having a plurality of triangular grooves. Each of the foam hexagonal elongate cells 1700 can have a length that is substantially equal to the width of the foam mattress foundation 1720.

The foam hexagonal elongate cells 1700 can have varying firmness characteristics. For example, one or more first foam hexagonal elongate cells from among the foam hexagonal elongate cells 1700 can include a first firmness characteristic. One or more second foam hexagonal elongate cells from among the foam hexagonal elongate cells 1700 includes a second firmness characteristic different from the first firmness characteristic. One or more third foam hexagonal elongate cells from among the foam hexagonal elongate cells 1700 can include a third firmness characteristic different from the first and second firmness characteristics. The user can place the foam hexagonal elongate cells 1700 with the varying firmness characteristics in a configuration on the foam mattress foundation 1720 that is conducive to the user's comfort preferences. For example, softer foam hexagonal elongate cells 1700 may be placed near where the head lays, whereas firmer foam hexagonal elongate cells 1700 may be placed near where the back is supported, and so forth.

Figure 18:
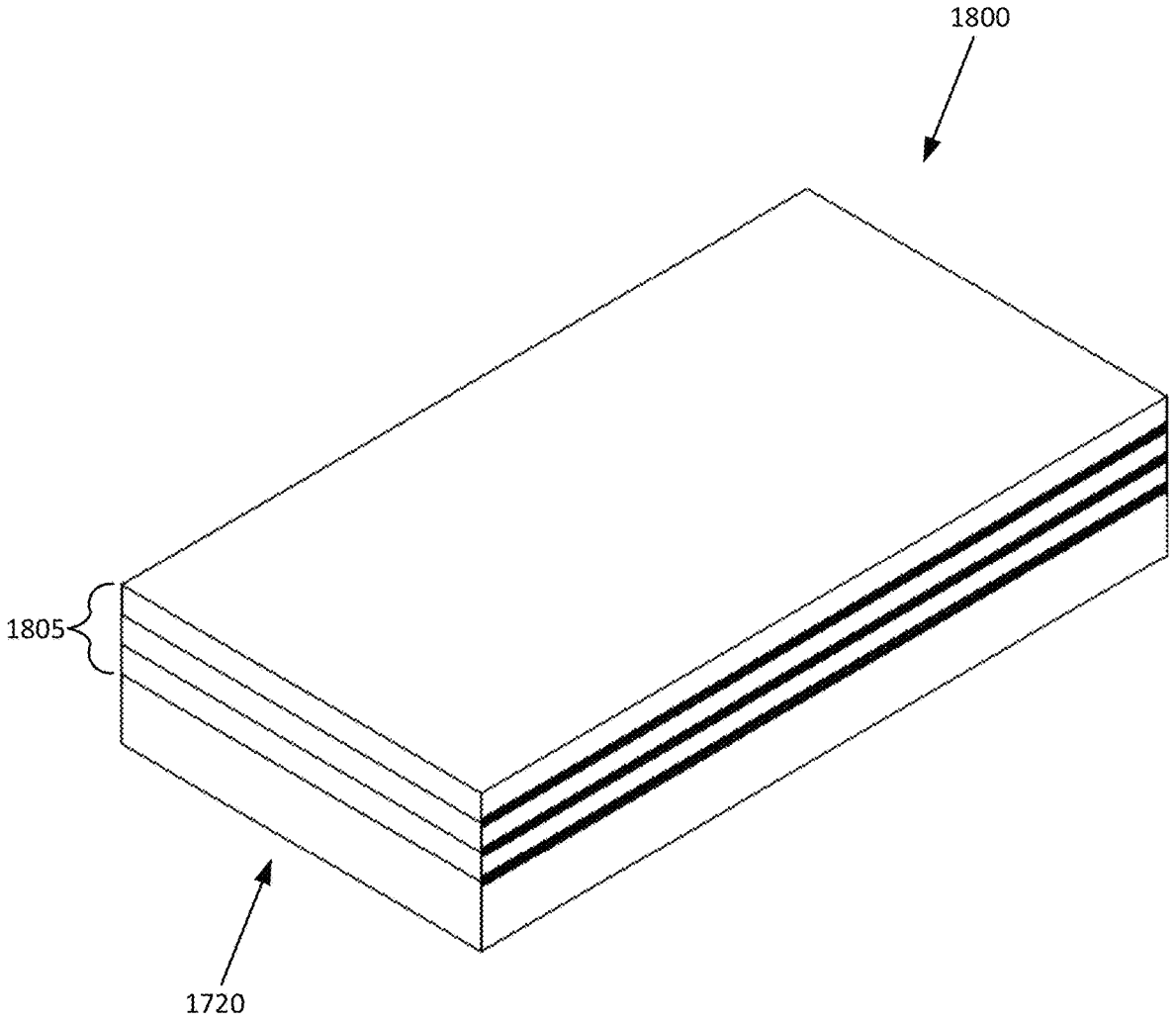
FIG. 18 illustrates the configurable foam mattress comfort system of FIG. 17 in an assembled configuration in accordance with various embodiments of the present inventive concept.

FIG. 18 illustrates the configurable foam mattress comfort system of FIG. 17 in an assembled configuration 1800 in accordance with various embodiments of the present inventive concept. As shown in the assembled configuration 1800 of FIG. 18, there is a single foam mattress foundation 1720 and multiple rectangular foam top layers 1805. It will be understood that any suitable number of rectangular foam top layers may be disposed atop the single foam mattress foundation 1720.

Figure 19:
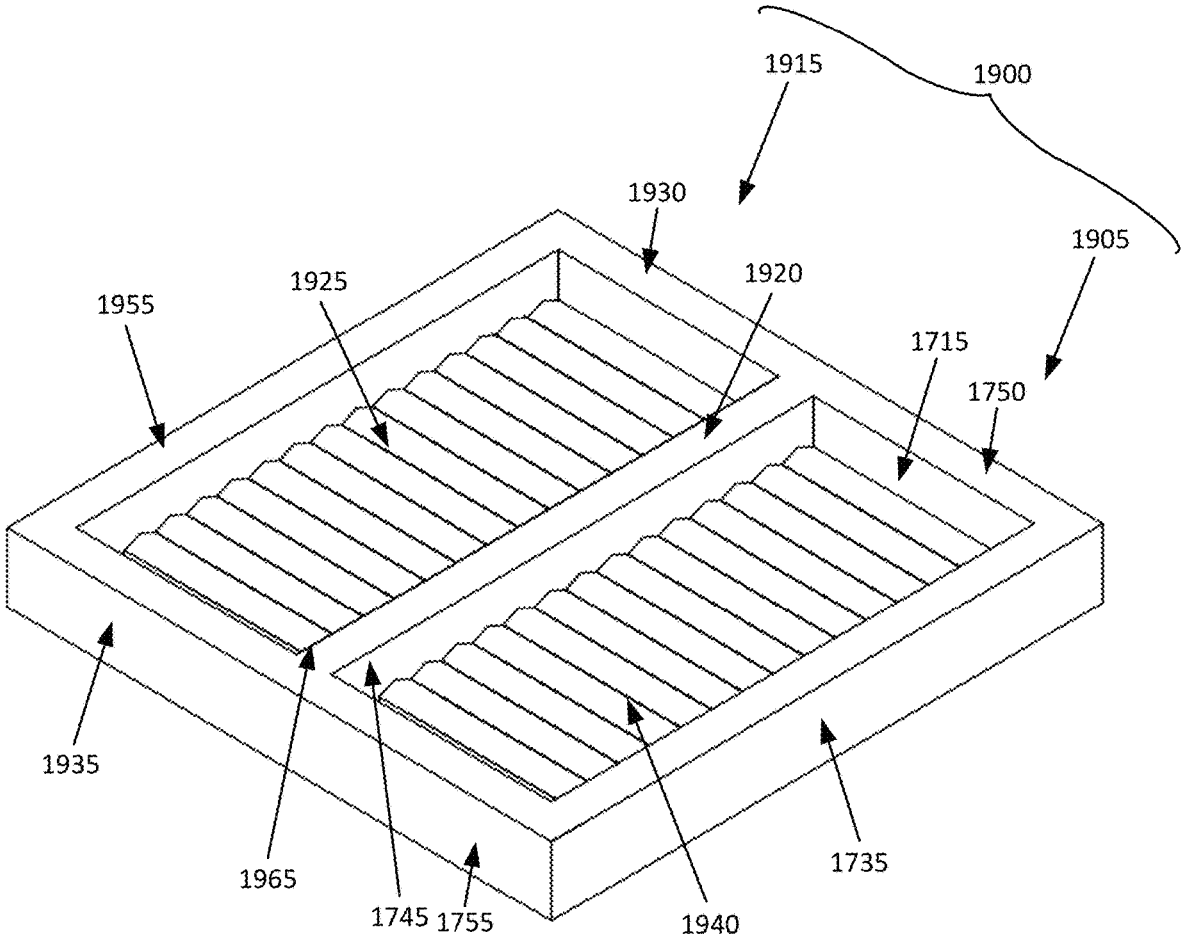
FIG. 19 illustrates a configurable foam mattress comfort system having two compartments separated by a dividing wall in accordance with various embodiments of the present inventive concept.

FIG. 19 illustrates a configurable foam mattress comfort system having two compartments (e.g., 1905 and 1915) separated by a dividing wall 1920 in accordance with various embodiments of the present inventive concept. The configurable foam mattress comfort system can include a foam mattress foundation 1900. The foam mattress foundation 1900 can include a first compartment 1905 having an upper surface with triangular grooves (e.g., 1940) disposed across a width thereof. The foam mattress foundation 1900 can include a second compartment 1915 having an upper surface with triangular grooves 1925 disposed across a width thereof.

The configurable foam mattress comfort system can include a first group of foam hexagonal elongate cells (e.g., 1700 of FIG. 17) that are configured to fit partially within corresponding triangular grooves (e.g., 1940) disposed across the width of the first compartment 1905. The configurable foam mattress comfort system can include a second group of foam hexagonal elongate cells (e.g., 1700) that are configured to fit partially within corresponding triangular grooves 1925 disposed across the width of the second compartment 1915. The configurable foam mattress comfort system can include a dividing wall 1920 between the first compartment 1905 and the second compartment 1915. The dividing wall 1920 can be made of foam, such as a firm foam that is firmer than the foam of the foam hexagonal elongate cells (e.g., 1700 of FIG. 17).

The first compartment 1905 of the foam mattress foundation includes a first side 1735 and a second side 1745. The width of the first compartment 1905 of the foam mattress foundation 1900 extends from the first side 1735 to the second side 1745. The first compartment 1905 of the foam mattress foundation 1900 includes a third side 1750 and a fourth side 1755. A length of the first compartment 1905 of the foam mattress foundation 1900 extends from the third side 1750 to the fourth side 1755.

The foam hexagonal elongate cells (e.g., 1700 of FIG. 17) can extend horizontally from the first side 1735 to the second side 1745 of the first compartment 1905 of the foam mattress foundation 1900 when the foam hexagonal elongate cells (e.g., 1700 of FIG. 17) are fit partially within the corresponding triangular grooves from among the triangular grooves (e.g., 1940) disposed across the width of the first compartment 1905 of the foam mattress foundation 1900. In some embodiments, the second side 1745 of the first compartment 1905 can be the same as the dividing wall 1920.

The second compartment 1915 of the foam mattress foundation 1900 includes a first side 1955 and a second side 1965. The width of the second compartment 1915 of the foam mattress foundation 1900 extends from the first side 1955 to the second side 1965. The second compartment 1915 of the foam mattress foundation 1900 includes a third side 1930 and a fourth side 1935. A length of the second compartment 1915 of the foam mattress foundation 1900 extends from the third side 1930 to the fourth side 1935. The foam hexagonal elongate cells (e.g., 1700 of FIG. 17) can be configured to extend horizontally from the first side 1965 to the second side 1955 of the second compartment 1915 of the foam mattress foundation 1900 when the foam hexagonal elongate cells (e.g., 1700 of FIG. 17) are fit partially within the corresponding triangular grooves from among the triangular grooves (e.g., 1925) disposed across the width of the second compartment 1915 of the foam mattress foundation 1900. In some embodiments, the second side 1965 of the second compartment 1915 can be the same as the dividing wall 1920. Each of the foam hexagonal elongate cells (e.g., 1700 of FIG. 17) fitted within the first compartment 1905 can have a length that is substantially equal to the width of the first compartment 1905 of the foam mattress foundation 1900. Similarly, each of the foam hexagonal elongate cells (e.g., 1700 of FIG. 17) can have a length that is substantially equal to the width of the second compartment 1915 of the foam mattress foundation 1900.

The one or more rectangular foam top layers (e.g., 1705, 1710) can be disposed atop the foam hexagonal elongate cells (e.g., 1700) of each of the compartments (e.g., 1905, 1915). In some embodiments, the one or more rectangular foam top layers (e.g., 1705, 1710) have a width and a length that are the same as the foam mattress foundation 1900 such that a single rectangular foam top layer covers both of the compartments (e.g., 1905, 1915). The one or more rectangular foam top layers (e.g., 1705, 1710) can include a planar upper surface and a planar lower surface. The planar lower surface can be in contact with an apex (e.g., 1760 of FIG. 17) of each of the hexagonal elongate cells (e.g., 1700 of FIG. 17) of each of the compartments (e.g., 1905, 1915). The foam hexagonal elongate cells (e.g., 1700 of FIG. 17) can collectively form an upper surface having a plurality of triangular grooves.

The foam hexagonal elongate cells (e.g., 1700 of FIG. 17) are configured to be custom-stacked on the foam mattress foundation 1900 within each of the compartments (e.g., 1905, 1915) in accordance with a user's desired comfort configuration. For example, in the first compartment 1905, firmer cells can be placed in the middle of the mattress foundation 105 to support the back, while softer cells can be placed near the area where the head rests. Whereas in the second compartment 1915, the sleeper on that side of the mattress might prefer firmer cells to support the head and softer cells to support the back. The shape of the configurable foam comfort system is modular and can be adjusted based on how many cells 1700 are stacked in a given region. The cells 1700 can be rearranged to create a customized comfort level and shape for each compartment (e.g., 1905, 1915).

Figure 20:
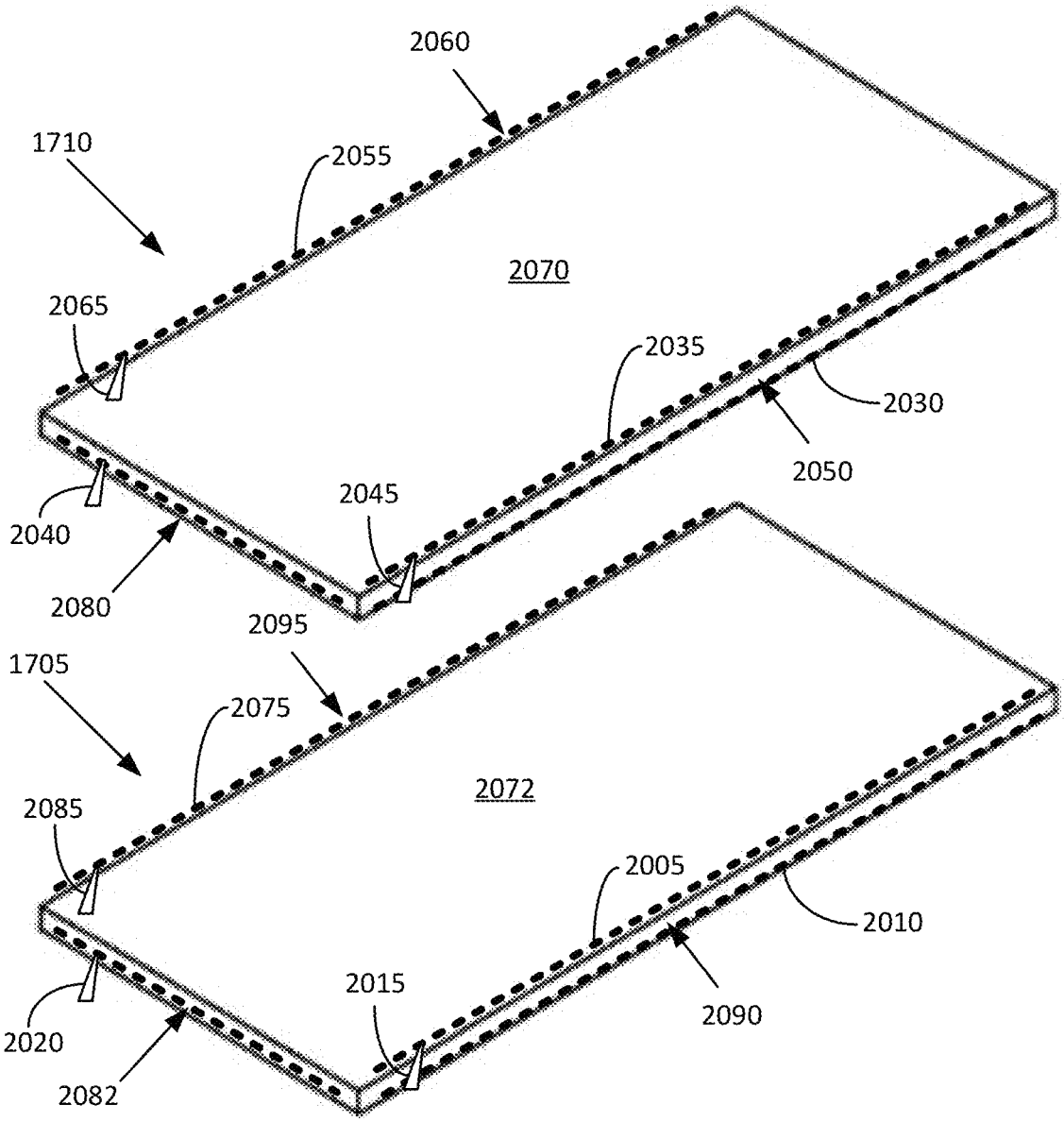
FIG. 20 illustrates two rectangular foam top layers in accordance with various embodiments of the present inventive concept.
Figure 21:
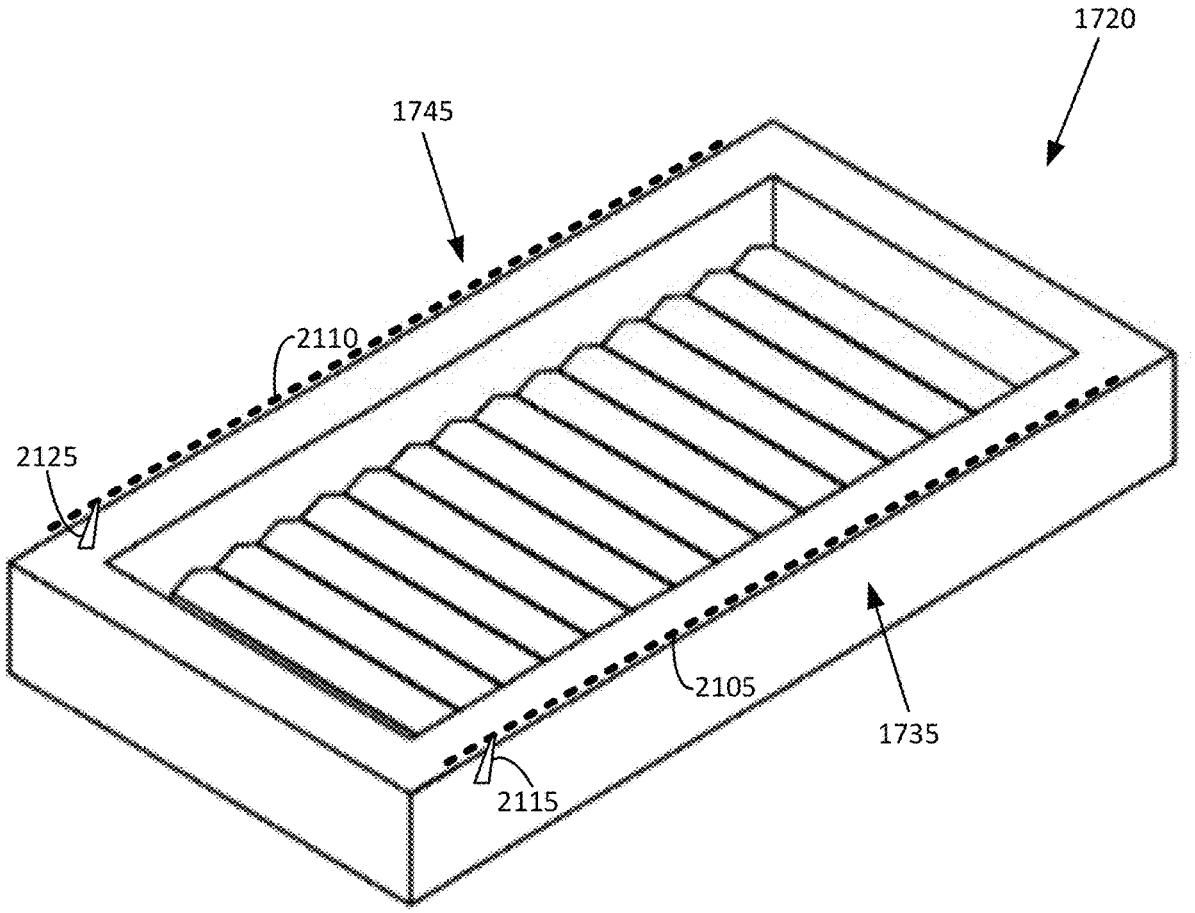
FIG. 21 illustrates a foam mattress foundation of a configurable foam mattress comfort system having a single compartment in accordance with various embodiments of the present inventive concept.

FIG. 20 illustrates two rectangular foam top layers 1705 and 1710 in accordance with various embodiments of the present inventive concept. FIG. 21 illustrates a foam mattress foundation 1720 of a configurable foam mattress comfort system having a single compartment in accordance with various embodiments of the present inventive concept. Reference is now made to FIGS. 20 and 21.

The configurable foam mattress comfort system can include a first zipper slider (e.g., 2115), a second zipper slider (e.g., 2125), a third zipper slider (e.g., 2015), and a fourth zipper slider (e.g., 2085). The first rectangular foam top layer (e.g., 1705) can include a first side (e.g., 2090) and a second side (e.g., 2095). The second rectangular foam top layer (e.g., 1710) can include a first side (e.g., 2050) and a second side (e.g., 2060). The foam mattress foundation (e.g., 1720, 1900) can include zipper teeth (e.g., 2105) disposed at an upper edge of the first side (e.g., 1735) of the foam mattress foundation (e.g., 1720, 1900). The first rectangular foam top layer (e.g., 1705) can include zipper teeth (e.g., 2010) disposed at a lower edge of the first side (e.g., 2090) of the first rectangular foam top layer (e.g., 1705). The first zipper slider (e.g., 2115) may be configured to join the zipper teeth 2105 to the zipper teeth 2010.

The foam mattress foundation (e.g., 1720, 1900) can include zipper teeth 2110 disposed at an upper edge of the second side 1745 of the foam mattress foundation (e.g., 1720, 1900). The first rectangular foam top layer (e.g., 1705) can include zipper teeth (not shown) disposed at a lower edge of the second side 2095 of the first rectangular foam top layer 1705. The second zipper slider (e.g., 2125) can be configured to join the zipper teeth 2110 to the zipper teeth (not shown) disposed at a lower edge of the second side 2095 of the first rectangular foam top layer 1705.

The first rectangular foam top layer (e.g., 1705) can include zipper teeth 2005 disposed at an upper edge of the first side 2090 of the first rectangular foam top layer 1705. The second rectangular foam top layer (e.g., 1710) can include zipper teeth 2030 disposed at a lower edge of the first side 2050 of the second rectangular foam top layer 1710. The third zipper slider (e.g., 2015) can be configured to join the zipper teeth 2005 to the zipper teeth 2030.

The first rectangular foam top layer (e.g., 1705) can include zipper teeth 2075 disposed at an upper edge of the second side 2095 of the first rectangular foam top layer 1705. The second rectangular foam top layer (e.g., 1710) can include zipper teeth (not shown) disposed at a lower edge of the second side 2060 of the second rectangular foam top layer 1710. The fourth zipper slider (e.g., 2085) can be configured to join the zipper teeth 2075 to the zipper teeth (not shown) disposed at a lower edge of the second side 2060 of the second rectangular foam top layer 1710. Accordingly, the rectangular foam top layer can be attached and detached to and from each other, and attached and detached to and from the firm foam foundation on each side thereof. This provides a sturdy mattress configuration in which the various layers do not slide around when the mattress is being occupied by a user, while providing a form-fit customizable experience to the user. It will be understood that instead of using zipper teeth and zipper sliders, other attachment and detachments means can be used, such as Velcro®, buttons, snaps, magnets, or the like. For example, in place of the zipper teeth on the edges, a strip of Velcro® can be used on each edge to attach and detach one layer from another, or a layer to and from the firm foam foundation. Similarly, buttons, snaps, magnets, or the like, can be used to join together and separate the various layers to and from each other.

Each of the rectangular foam top layers (e.g., 1705 and 1710) may be enclosed within a sleeve (e.g., 2072, 2070). The actual foam itself can be slipped into the corresponding sleeve through an opening (e.g., 2082, 2080). The opening into the sleeves can be opened and closed using a corresponding zipper slider (e.g., 2020, 2040).

The rectangular foam top layer 1710 can include zipper teeth 2035, zipper slider 2045, zipper teeth 2055, and zipper slider 2065 to attach to yet another rectangular foam top layer (not shown) disposed atop the rectangular foam top layer 1710, if desired by the user. In the embodiment with multiple compartments (e.g., FIG. 19), the rectangular foam top layers (e.g., 1705, 1710) can be sized to match the length and width of the firm foam foundation 1900, and can attach and detach to and from the firm foam foundation 1900 on each side thereof using the zipper teeth and zipper sliders disclosed herein.

Figure 22:
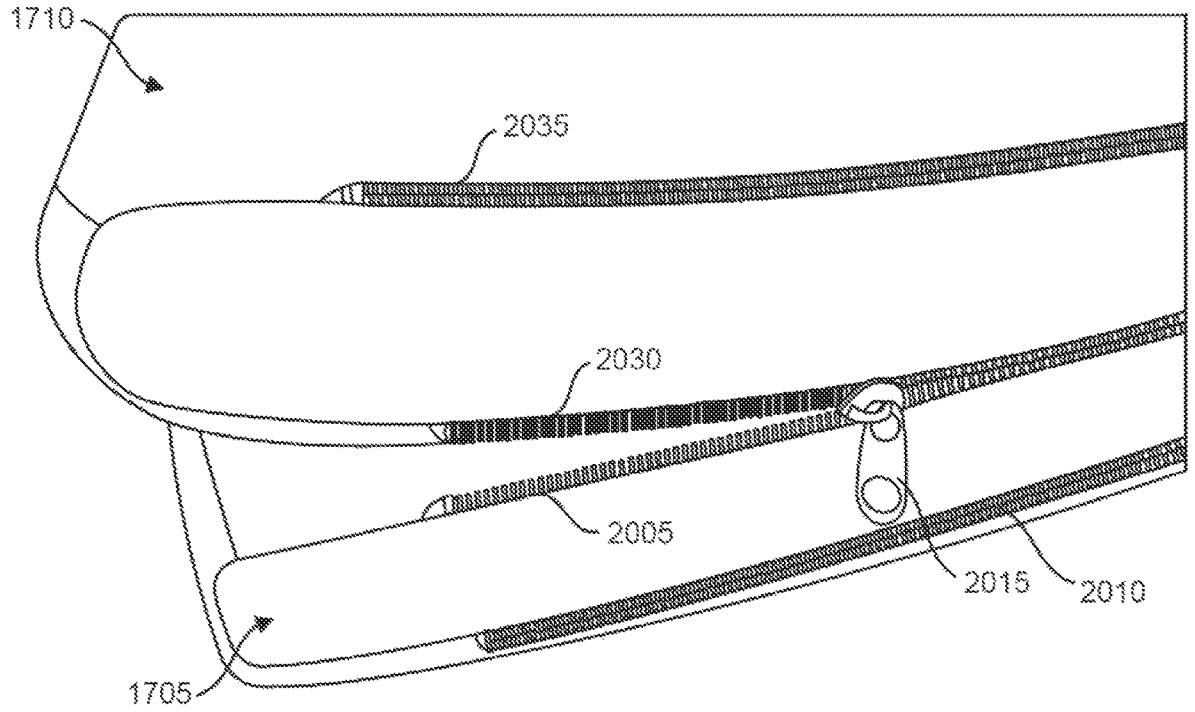
FIG. 22 illustrates two rectangular foam top layers coupled together in accordance with various embodiments of the present inventive concept.

FIG. 22 illustrates a perspective view of two rectangular foam top layers 1705 and 1710 coupled together in accordance with various embodiments of the present inventive concept. As can be seen in FIG. 22, the rectangular foam top layer 1705 can be joined to and separated from the rectangular foam top layer 1710 using the zipper slider 2015 and the zipper teeth 2005 and 2030.

Figure 23:
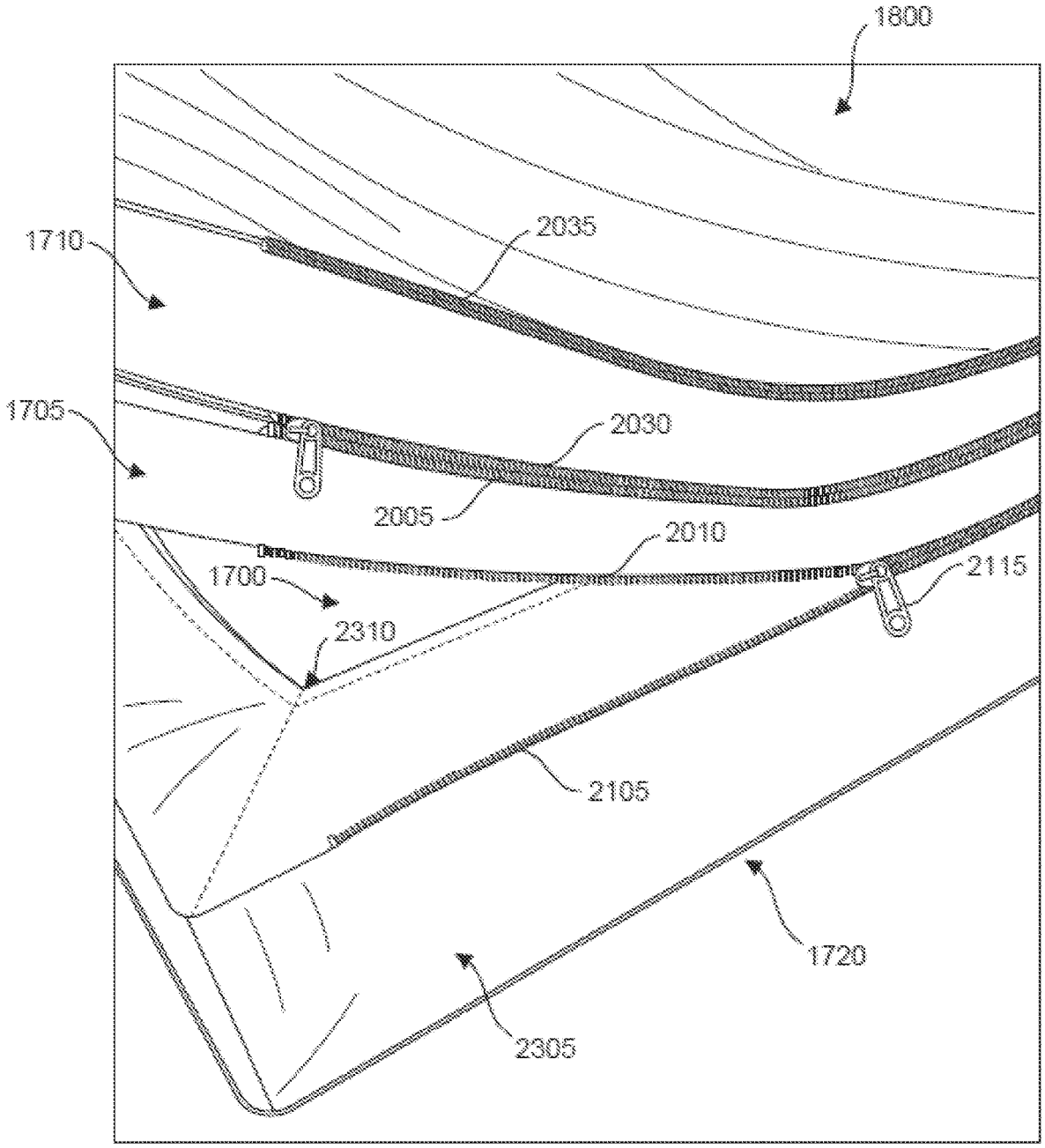
FIG. 23 illustrates two rectangular foam top layers coupled to each other, and to a foam mattress foundation, in accordance with various embodiments of the present inventive concept.

FIG. 23 illustrates two rectangular foam top layers 1705 and 1710 coupled to each other, and to a foam mattress foundation 1720, in accordance with various embodiments of the present inventive concept. As can be seen in FIG. 23, the rectangular foam top layer 1705 can be joined to and separated from the rectangular foam top layer 1710 using the zipper slider 2015 and the zipper teeth 2005 and 2030. The rectangular foam top layer 1705 can be joined to and separated from the firm foam foundation 1720 using the zipper slider 2115 and the zipper teeth 2105 and 2010. The firm foam foundation 1720 can include a skirt 2305 that at least partially encloses the firm foam parts of the firm foam foundation 1720. The firm foam foundation 1720 can further include an inner skirt 2310 that can be disposed at least partially over sides of the firm foam foundation 1720 and/or at least partially over one or more of the foam hexagonal cells 1700.

Figure 24:
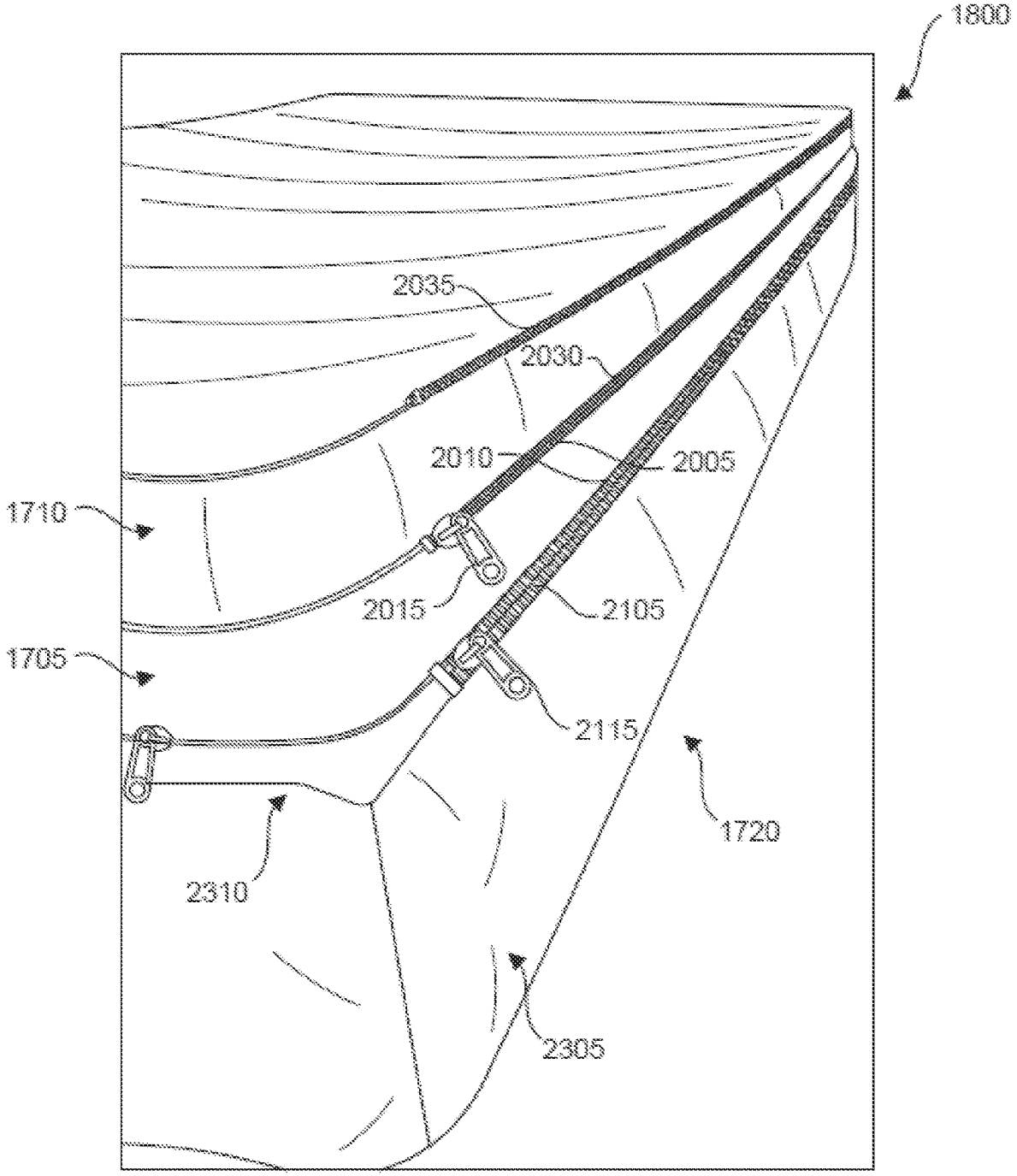
FIG. 24 illustrates a perspective view of the configurable foam mattress comfort system in an assembled configuration in accordance with various embodiments of the present inventive concept.

FIG. 24 illustrates a perspective view of the configurable foam mattress comfort system in an assembled configuration 1800 in accordance with various embodiments of the present inventive concept. The reference numerals and parts of the assembled configuration 1800 are explained in detail above, and therefore, a detailed description is not necessarily repeated. In the assembled configuration 1800, two rectangular foam top layers (e.g., 1705, 1710) are attached to each other, and the bottom rectangular foam top layer (e.g., 1705) is attached to the firm foam foundation 1720, as shown.

Embodiments are described herein, and illustrated in the drawings, in terms of functional blocks, units, and/or modules of a configurable foam comfort system. Having described and illustrated the principles of the inventive concept with reference to illustrated embodiments, it will be recognized that the illustrated embodiments can be modified in arrangement and detail without departing from such principles, and can be combined in any desired manner. And although the foregoing discussion has focused on particular embodiments, other configurations are contemplated. In particular, even though expressions such as "according to an embodiment of the invention" or the like are used herein, these phrases are meant to generally reference embodiment possibilities, and are not intended to limit the inventive concept to particular embodiment configurations. As used herein, these terms can reference the same or different embodiments that are combinable into other embodiments.

Consequently, in view of the wide variety of permutations to the embodiments described herein, this detailed description and accompanying material is intended to be illustrative only, and should not be taken as limiting the scope of the inventive concept. What is claimed as the invention, therefore, is all such modifications as may come within the scope and spirit of the following claims and equivalents thereto.

The invention claimed is:

1. A configurable foam mattress comfort system, comprising:

a foam mattress foundation including an upper surface having a plurality of triangular grooves disposed across a width thereof; and a plurality of foam hexagonal elongate cells configured to fit partially within corresponding triangular grooves from among the plurality of triangular grooves disposed across the width thereof, wherein:

the foam mattress foundation includes a first side and a second side;

the width of the foam mattress foundation extends from the first side to the second side;

the foam mattress foundation includes a third side and a fourth side;

a length of the foam mattress foundation extends from the third side to the fourth side;

the plurality of foam hexagonal elongate cells are configured to extend horizontally from the first side to the second side of the foam mattress foundation when the plurality of foam hexagonal elongate cells are fit partially within the corresponding triangular grooves from among the plurality of triangular grooves disposed across the width of the foam mattress foundation;

the configurable foam mattress comfort system further comprises one or more rectangular foam top layers disposed atop the plurality of foam hexagonal elongate cells;

the one or more rectangular foam top layers include a planar upper surface and a planar lower surface;

the planar lower surface is in contact with an apex of each of the plurality of foam hexagonal elongate cells;

the plurality of foam hexagonal elongate cells collectively form an upper surface having a plurality of triangular grooves;

the plurality of triangular grooves is a first plurality of triangular grooves;

the configurable foam mattress comfort system further comprises a foam body support section;

the foam body support section includes a raised arcuate upper surface section; and the foam body support section includes a lower section having a second plurality of triangular grooves configured to fit together with the first plurality of triangular grooves.

2. The configurable foam mattress comfort system of claim 1, wherein the plurality of foam hexagonal elongate cells are configured to be custom-stacked on each other and on the foam mattress foundation in accordance with a user's desired comfort configuration.

3. The configurable foam mattress comfort system of claim 1, wherein each of the plurality of foam hexagonal elongate cells has a length that is substantially equal to the width of the foam mattress foundation.

4. The configurable foam mattress comfort system of claim 1, further comprising a zipper slider, wherein:

the one or more rectangular foam top layers includes a first side;

the foam mattress foundation includes a first plurality of zipper teeth disposed at an upper edge of the first side of the foam mattress foundation;

the one or more rectangular foam top layers includes a second plurality of zipper teeth disposed at a lower edge of the first side of the one or more rectangular foam top layers; and the zipper slider is configured to join the first plurality of zipper teeth to the second plurality of zipper teeth.

5. The configurable foam mattress comfort system of claim 4, further comprising a second zipper slider, wherein:

the zipper slider is a first zipper slider;

the one or more rectangular foam top layers includes a second side;

the foam mattress foundation includes a third plurality of zipper teeth disposed at an upper edge of the second side of the foam mattress foundation;

the one or more rectangular foam top layers includes a fourth plurality of zipper teeth disposed at a lower edge of the second side of the one or more rectangular foam top layers; and the second zipper slider is configured to join the third plurality of zipper teeth to the fourth plurality of zipper teeth.

6. The configurable foam mattress comfort system of claim 1, further comprising:

a first zipper slider;

a second zipper slider;

a third zipper slider; and a fourth zipper slider, wherein:

the one or more rectangular foam top layers includes a first rectangular foam top layer and a second rectangular foam top layer;

the first rectangular foam top layer includes a first side and a second side;

the second rectangular foam top layer includes a first side and a second side;

the foam mattress foundation includes a first plurality of zipper teeth disposed at an upper edge of the first side of the foam mattress foundation;

the first rectangular foam top layer includes a second plurality of zipper teeth disposed at a lower edge of the first side of the first rectangular foam top layer;

the first zipper slider is configured to join the first plurality of zipper teeth to the second plurality of zipper teeth;

the foam mattress foundation includes a third plurality of zipper teeth disposed at an upper edge of the second side of the foam mattress foundation;

the first rectangular foam top layer includes a fourth plurality of zipper teeth disposed at a lower edge of the second side of the first rectangular foam top layer;

the second zipper slider is configured to join the third plurality of zipper teeth to the fourth plurality of zipper teeth;

the first rectangular foam top layer includes a fifth plurality of zipper teeth disposed at an upper edge of the first side of the first rectangular foam top layer;

the second rectangular foam top layer includes a sixth plurality of zipper teeth disposed at a lower edge of the first side of the second rectangular foam top layer;

the third zipper slider is configured to join the fifth plurality of zipper teeth to the sixth plurality of zipper teeth;

the first rectangular foam top layer includes a seventh plurality of zipper teeth disposed at an upper edge of the second side of the first rectangular foam top layer;

the second rectangular foam top layer includes an eighth plurality of zipper teeth disposed at a lower edge of the second side of the second rectangular foam top layer; and the fourth zipper slider is configured to join the seventh plurality of zipper teeth to the eighth plurality of zipper teeth.

7. The configurable foam mattress comfort system of claim 1, wherein the one or more rectangular foam top layers includes memory foam.

8. The configurable foam mattress comfort system of claim 1, wherein:

one or more first foam hexagonal elongate cells from among the plurality of foam hexagonal elongate cells includes a first firmness characteristic;

one or more second foam hexagonal elongate cells from among the plurality of foam hexagonal elongate cells includes a second firmness characteristic different from the first firmness characteristic; and one or more third foam hexagonal elongate cells from among the plurality of foam hexagonal elongate cells includes a third firmness characteristic different from the first and second firmness characteristics.

9. A configurable foam mattress comfort system, comprising:

a foam mattress foundation including:

a first compartment having an upper surface with a first plurality of triangular grooves disposed across a width thereof; and a second compartment having an upper surface with a second plurality of triangular grooves disposed across a width thereof;

a first plurality of foam hexagonal elongate cells configured to fit partially within corresponding triangular grooves from among the first plurality of triangular grooves disposed across the width of the first compartment;

a second plurality of foam hexagonal elongate cells configured to fit partially within corresponding triangular grooves from among the second plurality of triangular grooves disposed across the width of the second compartment; and a dividing wall between the first compartment and the second compartment, wherein:

the first compartment of the foam mattress foundation includes a first side and a second side;

the width of the first compartment of the foam mattress foundation extends from the first side to the second side;

the first compartment of the foam mattress foundation includes a third side and a fourth side;

a length of the first compartment of the foam mattress foundation extends from the third side to the fourth side;

the first plurality of foam hexagonal elongate cells are configured to extend horizontally from the first side to the second side of the first compartment of the foam mattress foundation when the first plurality of foam hexagonal elongate cells are fit partially within the corresponding triangular grooves from among the first plurality of triangular grooves disposed across the width of the first compartment of the foam mattress foundation;

the first plurality of foam hexagonal elongate cells and the second plurality of foam hexagonal elongate cells are configured to be custom-stacked on the foam mattress foundation in accordance with a user's desired comfort configuration;

the configurable foam mattress comfort system further comprises a foam body support section;

the foam body support section includes a raised arcuate upper surface section; and the foam body support section includes a lower section having a third plurality of triangular grooves configured to fit together with at least one of i) the first plurality of triangular grooves or ii) the second plurality of triangular grooves.

10. The configurable foam mattress comfort system of claim 9, wherein the second side of the first compartment is the dividing wall.

11. The configurable foam mattress comfort system of claim 9, wherein:

the second compartment of the foam mattress foundation includes a first side and a second side;

the width of the second compartment of the foam mattress foundation extends from the first side to the second side;

the second compartment of the foam mattress foundation includes a third side and a fourth side;

a length of the second compartment of the foam mattress foundation extends from the third side to the fourth side; and the second plurality of foam hexagonal elongate cells are configured to extend horizontally from the first side to the second side of the second compartment of the foam mattress foundation when the second plurality of foam hexagonal elongate cells are fit partially within the corresponding triangular grooves from among the second plurality of triangular grooves disposed across the width of the second compartment of the foam mattress foundation.

12. The configurable foam mattress comfort system of claim 11, wherein the second side of the second compartment is the dividing wall.

13. The configurable foam mattress comfort system of claim 9, further comprising one or more rectangular foam top layers disposed atop the first plurality of foam hexagonal elongate cells and the second plurality of foam hexagonal elongate cells, wherein:

the one or more rectangular foam top layers include a planar upper surface and a planar lower surface; and the planar lower surface is in contact with an apex of each of the first plurality of foam hexagonal elongate cells and the second plurality of foam hexagonal elongate cells.

14. The configurable foam mattress comfort system of claim 9, wherein the first plurality of foam hexagonal elongate cells and the second plurality of foam hexagonal elongate cells collectively form an upper surface having a plurality of triangular grooves.

15. The configurable foam mattress comfort system of claim 9, wherein:

each of the first plurality of foam hexagonal elongate cells has a length that is substantially equal to the width of the first compartment of the foam mattress foundation; and each of the second plurality of foam hexagonal elongate cells has a length that is substantially equal to the width of the second compartment of the foam mattress foundation.

16. The configurable foam mattress comfort system of claim 9, further comprising:

a first rectangular foam top layer;

a first zipper slider; and a second zipper slider, wherein:

the first rectangular foam top layer includes a first side and a second side;

the first compartment of the foam mattress foundation includes a first plurality of zipper teeth disposed at an upper edge of the first side of the first compartment of the foam mattress foundation;

the first rectangular foam top layer includes a second plurality of zipper teeth disposed at a lower edge of the first side of the first rectangular foam top layer;

the first zipper slider is configured to join the first plurality of zipper teeth to the second plurality of zipper teeth;

the second compartment of the foam mattress foundation includes a third plurality of zipper teeth disposed at an upper edge of the first side of the second compartment of the foam mattress foundation;

the first rectangular foam top layer includes a fourth plurality of zipper teeth disposed at a lower edge of the second side of the first rectangular foam top layer; and the second zipper slider is configured to join the third plurality of zipper teeth to the fourth plurality of zipper teeth.

17. The configurable foam mattress comfort system of claim 16, further comprising:

a second rectangular foam top layer;

a third zipper slider; and a fourth zipper slider, wherein:

the second rectangular foam top layer includes a first side and a second side;

the first rectangular foam top layer includes a fifth plurality of zipper teeth disposed at an upper edge of the first side of the first rectangular foam top layer;

the second rectangular foam top layer includes a sixth plurality of zipper teeth disposed at a lower edge of the first side of the second rectangular foam top layer;

the third zipper slider is configured to join the fifth plurality of zipper teeth to the sixth plurality of zipper teeth;

the first rectangular foam top layer includes a seventh plurality of zipper teeth disposed at an upper edge of the second side of the first rectangular foam top layer;

the second rectangular foam top layer includes an eighth plurality of zipper teeth disposed at a lower edge of the second side of the second rectangular foam top layer; and the fourth zipper slider is configured to join the seventh plurality of zipper teeth to the eighth plurality of zipper teeth.

18. The configurable foam mattress comfort system of claim 9, wherein the dividing wall is made of foam.

* * * * *